US011857142B2

(12) United States Patent
Conrad

(10) Patent No.: US 11,857,142 B2
(45) Date of Patent: Jan. 2, 2024

(54) SURFACE CLEANING APPARATUS HAVING AN ENERGY STORAGE MEMBER AND A CHARGER FOR AN ENERGY STORAGE MEMBER

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/576,347

(22) Filed: Jan. 14, 2022

(65) Prior Publication Data

US 2022/0133111 A1 May 5, 2022

Related U.S. Application Data

(60) Continuation of application No. 16/280,930, filed on Feb. 20, 2019, and a continuation-in-part of (Continued)

(51) Int. Cl.
*A47L 9/28* (2006.01)
*A47L 5/22* (2006.01)
(Continued)

(52) U.S. Cl.
CPC ..... *A47L 9/2878* (2013.01); *A47L 5/225* (2013.01); *A47L 5/24* (2013.01); *A47L 9/02* (2013.01); *A47L 9/2884* (2013.01); *A47L 9/322* (2013.01)

(58) Field of Classification Search
CPC ..... A47L 11/4005; A47L 11/4002; A47L 11/4011; A47L 2201/022; A47L 5/225;
(Continued)

(56) References Cited

U.S. PATENT DOCUMENTS 911,258 A 2/1909 Neumann
1,600,762 A 9/1926 Hawley
(Continued)

FOREIGN PATENT DOCUMENTS

AU 112778 4/1940
CA 1077412 A1 5/1980
(Continued)

OTHER PUBLICATIONS

Makita Instruction Manual: Cordless Cleaner, BCL 180, at least as early as Jan. 2003.
(Continued)

*Primary Examiner* — Brian D Keller
*Assistant Examiner* — Tim Brady
(74) *Attorney, Agent, or Firm* — Philip C. Mendes da Costa; BERESKIN & PARR LLP/S.E.N.C.R.L., s.r.l.

(57) ABSTRACT

A surface cleaning apparatus includes a floor cleaning unit and a portable surface cleaning unit. The floor cleaning unit includes a surface cleaning head, an upper section moveably mounted to the surface cleaning head between an upright storage position and a rearwardly inclined floor cleaning position, a charger having an energy storage member, and an air flow path extending from the dirty air inlet to a floor cleaning unit air outlet. The portable surface cleaning unit is connectable to the floor cleaning unit, and includes a portable surface cleaning unit air inlet connectable in air flow communication with the floor cleaning unit air outlet, a main body, an air treatment member, a suction motor, a handle and a capacitor. When fully charged, the energy storage member stores sufficient stored power to recharge the capacitor at least twice.

20 Claims, 22 Drawing Sheets

Related U.S. Application Data application No. 17/458,195, filed on Aug. 26, 2021, which is a continuation-in-part of application No. 16/270,693, filed on Feb. 8, 2019, now Pat. No. 11,202,539, which is a continuation of application No. 15/095,941, filed on Apr. 11, 2016, now Pat. No. 10,258,208, application No. 17/403,729 is a continuation-in-part of application No. 17/403,729, filed on Aug. 16, 2021, which is a continuation of application No. 16/182,947, filed on Nov. 7, 2018, now Pat. No. 11,122,943, which is a continuation of application No. 15/076,060, filed on Mar. 21, 2016, now Pat. No. 10,165,912, which is a continuation-in-part of application No. 14/822,211, filed on Aug. 10, 2015, now Pat. No. 9,888,817, said application No. 15/076,060 is a continuation-in-part of application No. 14/875,381, filed on Oct. 5, 2015, now Pat. No. 9,545,181, which is a continuation of application No. 13/782,217, filed on Mar. 1, 2013, now Pat. No. 9,192,269, which is a continuation-in-part of application No. 13/720,754, filed on Dec. 19, 2012, now Pat. No. 8,752,239, which is a division of application No. 11/954,331, filed on Dec. 12, 2007, now Pat. No. 8,359,705.

(60) Provisional application No. 62/093,189, filed on Dec. 17, 2014, provisional application No. 60/870,175, filed on Dec. 15, 2006, provisional application No. 60/884,767, filed on Jan. 12, 2007.

(51) Int. Cl.

| | |
|---|---|
| ***A47L 9/02*** | (2006.01) |
| ***A47L 5/24*** | (2006.01) |
| ***A47L 9/32*** | (2006.01) |

(58) Field of Classification Search

CPC . A47L 5/24; A47L 9/02; A47L 9/2874; A47L 9/2884; A47L 5/28; H02J 7/0042; H02J 7/0048

USPC ..... 15/321, DIG. 1, 79.2, 104.095, 328; 320/114, 115

See application file for complete search history.

(56) References Cited

U.S. PATENT DOCUMENTS

| | | | |
|---|---|---|---|
| 1,797,812 | A | 3/1931 | Waring |
| 1,898,608 | A | 2/1933 | Alexander |
| 1,937,765 | A | 12/1933 | Leathers |
| 2,015,464 | A | 9/1935 | Saint-Jacques |
| 2,152,114 | A | 3/1939 | Tongeren |
| 2,542,634 | A | 2/1951 | Davis |
| 2,678,110 | A | 5/1954 | Madsen |
| 2,731,102 | A | 1/1956 | James |
| 2,811,219 | A | 10/1957 | Wenzl |
| 2,846,024 | A | 8/1958 | Bremi |
| 2,913,111 | A | 11/1959 | Rogers |
| 2,917,131 | A | 12/1959 | Evans |
| 2,937,713 | A | 5/1960 | Stephenson et al. |
| 2,942,691 | A | 6/1960 | Dillon |
| 2,942,692 | A | 6/1960 | Benz |
| 2,946,451 | A | 7/1960 | Culleton |
| 2,952,330 | A | 9/1960 | Winslow |
| 2,981,369 | A | 4/1961 | Yellott et al. |
| 3,032,954 | A | 5/1962 | Racklyeft |
| 3,085,221 | A | 4/1963 | Francis |
| 3,130,157 | A | 4/1964 | Kelsall et al. |
| 3,200,568 | A | 8/1965 | McNeil |
| 3,204,772 | A | 9/1965 | Ruxton |
| 3,217,469 | A | 11/1965 | Eckert |
| 3,269,097 | A | 8/1966 | German |
| 3,320,727 | A | 5/1967 | Farley |
| 3,372,532 | A | 3/1968 | Campbell |
| 3,426,513 | A | 2/1969 | Bauer |
| 3,518,815 | A | 7/1970 | Peterson et al. |
| 3,530,649 | A | 9/1970 | Porsch et al. |
| 3,543,325 | A | 12/1970 | Hamrick |
| 3,561,824 | A | 2/1971 | Homan |
| 3,582,616 | A | 6/1971 | Wrob |
| 3,684,093 | A | 5/1972 | Kono |
| 3,675,401 | A | 7/1972 | Cordes |
| 3,822,533 | A | 7/1974 | Oranje |
| 3,898,068 | A | 8/1975 | McNeil et al. |
| 3,933,450 | A | 1/1976 | Percevaut |
| 3,988,132 | A | 10/1976 | Oranje |
| 3,988,133 | A | 10/1976 | Schady |
| 4,097,381 | A | 6/1978 | Ritzler |
| 4,187,088 | A | 2/1980 | Hodgson |
| 4,218,805 | A | 8/1980 | Brazier |
| 4,236,903 | A | 12/1980 | Malmsten |
| 4,307,485 | A | 12/1981 | Dessig |
| 4,373,228 | A | 2/1983 | Dyson |
| 4,382,804 | A | 5/1983 | Mellor |
| 4,409,008 | A | 10/1983 | Solymes |
| 4,486,207 | A | 12/1984 | Baillie |
| 4,494,270 | A | 1/1985 | Ritzau et al. |
| 4,523,936 | A | 6/1985 | Disanza, Jr. |
| 4,678,588 | A | 7/1987 | Shortt |
| 4,700,429 | A | 10/1987 | Martin et al. |
| 4,744,958 | A | 5/1988 | Pircon |
| 4,778,494 | A | 10/1988 | Patterson |
| 4,826,515 | A | 5/1989 | Dyson |
| D303,173 | S | 8/1989 | Miyamoto et al. |
| 4,853,008 | A | 8/1989 | Dyson |
| 4,853,011 | A | 8/1989 | Dyson |
| 4,853,111 | A | 8/1989 | MacArthur et al. |
| 4,900,270 | A | 2/1990 | Edwards et al. |
| 4,905,342 | A | 3/1990 | Ataka |
| 4,944,780 | A | 7/1990 | Usmani |
| 4,980,945 | A | 1/1991 | Bewley |
| 5,054,157 | A | 10/1991 | Werner et al. |
| 5,080,697 | A | 1/1992 | Finke |
| 5,090,976 | A | 2/1992 | Dyson |
| 5,129,125 | A | 7/1992 | Gamou et al. |
| 5,224,238 | A | 7/1993 | Barlett |
| 5,230,722 | A | 7/1993 | Yonkers |
| 5,254,019 | A | 10/1993 | Noschese |
| 5,267,371 | A | 12/1993 | Soler et al. |
| 5,287,591 | A | 2/1994 | Rench et al. |
| 5,307,538 | A | 5/1994 | Rench et al. |
| 5,309,600 | A | 5/1994 | Weaver et al. |
| 5,309,601 | A | 5/1994 | Hampton et al. |
| 5,347,679 | A | 9/1994 | Saunders et al. |
| 5,363,535 | A | 11/1994 | Rench et al. |
| 5,466,172 | A | 11/1995 | Carstens et al. |
| 5,481,780 | A | 1/1996 | Daneshvar |
| 5,515,573 | A | 5/1996 | Frey |
| 5,599,365 | A | 2/1997 | Alday et al. |
| D380,033 | S | 6/1997 | Theiss et al. |
| 5,704,400 | A | 1/1998 | Eldridge |
| 5,709,007 | A | 1/1998 | Chiang |
| 5,737,830 | A | 4/1998 | Yeomans |
| 5,755,096 | A | 5/1998 | Holleyman |
| 5,815,878 | A | 10/1998 | Murakami et al. |
| 5,815,881 | A | 10/1998 | Sjogreen |
| 5,858,038 | A | 1/1999 | Dyson et al. |
| 5,858,043 | A | 1/1999 | Geise |
| 5,893,938 | A | 4/1999 | Dyson et al. |
| 5,935,279 | A | 8/1999 | Kilstrom |
| 5,941,729 | A | 8/1999 | Sri-Jayantha |
| 5,950,274 | A | 9/1999 | Kilstrom |
| 5,970,572 | A | 10/1999 | Homas |
| 6,071,095 | A | 6/2000 | Verkaart |
| 6,071,321 | A | 6/2000 | Trapp et al. |
| 6,080,022 | A | 6/2000 | Shaberman et al. |
| 6,094,775 | A | 8/2000 | Behmer |
| 6,122,796 | A | 9/2000 | Downham et al. |
| 6,210,469 | B1 | 4/2001 | Tokar |
| 6,221,134 | B1 | 4/2001 | Conrad et al. |

(56) References Cited

U.S. PATENT DOCUMENTS 6,228,260 B1 5/2001 Conrad et al.
6,231,645 B1 5/2001 Conrad et al.
6,251,296 B1 6/2001 Conrad et al.
6,260,234 B1 7/2001 Wright et al.
6,295,692 B1 10/2001 Shideler
6,345,408 B1 2/2002 Nagai et al.
6,406,505 B1 6/2002 Oh et al.
6,434,785 B1 8/2002 Vandenbelt et al.
6,440,197 B1 8/2002 Conrad et al.
6,457,205 B1 10/2002 Conrad
D466,867 S 12/2002 Krobusek
6,500,025 B1 12/2002 Moenkhaus et al.
6,502,278 B2 1/2003 Oh et al.
6,519,810 B2 2/2003 Kim
6,531,066 B1 3/2003 Saunders et al.
6,536,072 B2 3/2003 Thur et al.
6,540,549 B2 4/2003 Rupert
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,712,868 B2 3/2004 Murphy et al.
6,732,403 B2 5/2004 Moore et al.
6,737,830 B2 5/2004 Bean et al.
6,746,500 B1 6/2004 Park et al.
6,782,583 B2 8/2004 Oh
6,782,585 B1 8/2004 Conrad et al.
6,810,558 B2 11/2004 Lee
6,818,036 B1 11/2004 Seaman
6,833,015 B2 12/2004 Oh et al.
6,868,578 B1 3/2005 Kasper et al.
6,874,197 B1 4/2005 Conrad
6,896,719 B2 5/2005 Coates et al.
6,929,516 B2 8/2005 Brochu et al.
6,962,506 B1 11/2005 Krobusek
6,968,596 B2 11/2005 Oh et al.
6,976,885 B2 12/2005 Lord
7,113,847 B2 9/2006 Chmura et al.
7,128,770 B2 10/2006 Oh et al.
7,160,346 B2 1/2007 Park
7,162,770 B2 1/2007 Davidshofer
7,175,682 B2 2/2007 Nakai et al.
7,188,388 B2 3/2007 Best et al.
7,198,656 B2 4/2007 Takemoto et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,426,768 B2 9/2008 Peterson et al.
7,429,284 B2 9/2008 Oh
7,448,363 B1 11/2008 Rasmussen et al.
7,449,040 B2 11/2008 Conrad et al.
7,485,164 B2 2/2009 Jeong et al.
7,488,363 B2 2/2009 Jeong et al.
7,547,337 B2 6/2009 Oh et al.
7,547,338 B2 6/2009 Kim et al.
7,563,298 B2 7/2009 Oh
7,565,853 B2 7/2009 Arnold et al.
7,588,616 B2 9/2009 Conrad et al.
7,597,730 B2 10/2009 Yoo et al.
7,628,831 B2 12/2009 Gomiciaga-Pereda et al.
7,740,676 B2 6/2010 Burnham et al.
7,770,256 B1 8/2010 Fester
7,776,120 B2 8/2010 Conrad
7,779,506 B2 8/2010 Kang et al.
7,798,845 B1 9/2010 Buchanan
7,803,207 B2 9/2010 Conrad
7,805,804 B2 10/2010 Loebig
7,811,349 B2 10/2010 Nguyen
7,867,308 B2 1/2011 Conrad
7,922,794 B2 4/2011 Morphey
7,931,716 B2 4/2011 Oakham
7,938,871 B2 5/2011 Llyod
7,979,959 B2 7/2011 Courtney
8,021,453 B2 9/2011 Howes
8,062,398 B2 11/2011 Luo et al.
8,078,761 B2 12/2011 Cardina
8,117,712 B2 2/2012 Dyson et al.
8,146,201 B2 4/2012 Conrad
8,151,407 B2 4/2012 Conrad
8,152,877 B2 4/2012 Greene
8,156,609 B2 4/2012 Milne et al.
8,161,599 B2 4/2012 Griffith et al.
8,183,819 B2 5/2012 Sugano
8,225,456 B2 7/2012 Hakan et al.
8,482,263 B2 7/2013 Barrade et al.
8,484,799 B2 7/2013 Conrad
8,673,487 B2 3/2014 Churchill
8,834,209 B2 9/2014 Conrad
9,192,269 B2 11/2015 Conrad
9,516,979 B2 12/2016 Gidwell
9,775,484 B2 10/2017 Conrad
10,080,471 B2 9/2018 Reimer et al.
10,105,022 B2 10/2018 Lim et al.
10,165,912 B2 * 1/2019 Conrad ..... A47L 5/225
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2003/0201754 A1 * 10/2003 Conrad ..... A47L 9/2873 320/116
2004/0010885 A1 1/2004 Hitzelberger et al.
2004/0025285 A1 2/2004 McCormick et al.
2004/0088817 A1 5/2004 Cochran et al.
2004/0216263 A1 11/2004 Best et al.
2004/0216264 A1 11/2004 Shaver et al.
2005/0000054 A1 1/2005 Ninomiya et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0090290 A1 5/2006 Lau
2006/0042206 A1 6/2006 Arnold et al.
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 10/2006 Oh et al.
2006/0230723 A1 10/2006 Kim et al.

(56) References Cited

U.S. PATENT DOCUMENTS

2006/0230724 A1 10/2006 Han et al.
2006/0236663 A1 10/2006 Oh
2006/0254226 A1 11/2006 Jeon
2006/0278081 A1 12/2006 Han et al.
2006/0288516 A1 12/2006 Sawalski
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0136984 A1* 6/2007 Hsu ..... A47L 5/28 15/339
2007/0209334 A1 9/2007 Conrad
2007/0209335 A1 9/2007 Conrad
2007/0271724 A1 11/2007 Hakan et al.
2007/0279011 A1 12/2007 Jones et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0057780 A1 3/2008 O'Rourke
2008/0134460 A1 6/2008 Conrad
2008/0134462 A1 6/2008 Jansen et al.
2008/0178416 A1 7/2008 Conrad
2008/0178420 A1 7/2008 Conrad
2008/0190080 A1 8/2008 Conrad
2008/0196194 A1 8/2008 Conrad
2008/0196745 A1 8/2008 Conrad
2008/0301903 A1 12/2008 Cunningham et al.
2009/0096430 A1* 4/2009 Van Der Linde ..... H02J 7/00 320/166
2009/0100633 A1 4/2009 Jeon
2009/0113659 A1 5/2009 Jeon
2009/0144932 A1 6/2009 Yoo
2009/0151114 A1 6/2009 Pineschi
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0307564 A1 12/2009 Vedantham et al.
2009/0307863 A1 12/2009 Milne et al.
2009/0307864 A1 12/2009 Dyson
2009/0307865 A1* 12/2009 Williamson ..... A47L 11/4005 15/347
2009/0308254 A1 12/2009 Oakham
2009/0313958 A1 12/2009 Gomiciaga-Pereda et al.
2009/0313959 A1 12/2009 Gomiciaga-Pereda et al.
2010/0083459 A1 4/2010 Beskow et al.
2010/0132319 A1 6/2010 Ashbee et al.
2010/0154150 A1 6/2010 Mcleod
2010/0175217 A1 7/2010 Conrad
2010/0197157 A1 8/2010 Wang
2010/0212104 A1 8/2010 Conrad
2010/0224073 A1 9/2010 Oh et al.
2010/0229321 A1 9/2010 Dyson et al.
2010/0229328 A1 9/2010 Conrad
2010/0242210 A1 9/2010 Conrad
2010/0243158 A1 9/2010 Conrad
2010/0293745 A1 11/2010 Coburn
2010/0299865 A1 12/2010 Conrad
2010/0299866 A1 12/2010 Conrad
2011/0023261 A1 2/2011 Proffitt, II et al.
2011/0146024 A1 6/2011 Conrad
2011/0168332 A1 7/2011 Bowe et al.
2011/0289716 A1* 12/2011 Williamson ..... A47L 9/2884 15/320
2012/0042471 A1 2/2012 Spiggle
2012/0060322 A1 3/2012 Simonelli et al.
2012/0216361 A1 8/2012 Millington et al.
2012/0222245 A1 9/2012 Conrad
2012/0222260 A1 9/2012 Conrad
2012/0222262 A1 9/2012 Conrad
2013/0312792 A1 11/2013 Hensel et al.
2014/0137362 A1 5/2014 Smith
2014/0137363 A1 5/2014 Wilson
2014/0137364 A1 5/2014 Stickney et al.
2014/0182080 A1 7/2014 Lee et al.
2014/0208538 A1 7/2014 Visel et al.
2014/0237755 A1 8/2014 Conrad
2015/0077043 A1 3/2015 Seidel et al.
2016/0051109 A1 2/2016 Hwang et al.
2016/0051464 A1 2/2016 Trzecieski
2016/0113455 A1 4/2016 Horvath et al.
2016/0198914 A1* 7/2016 Conrad ..... A47L 9/1683 15/329
2016/0285289 A1 9/2016 Arends
2017/0215663 A1 8/2017 Conrad et al.
2017/0245711 A1 8/2017 Son et al.
2017/0258282 A1 9/2017 Shinagawa
2017/0290479 A1* 10/2017 Conrad ..... A47L 9/1608
2017/0332855 A1 11/2017 Seo et al.
2018/0131205 A1 5/2018 Jin et al.
2018/0248389 A1 8/2018 Toya et al.
2018/0303303 A1 10/2018 Nyberg et al.
2018/0353037 A1 12/2018 Williams et al.
2018/0360278 A1* 12/2018 Yoshida ..... A47L 9/2878
2019/0014963 A1 1/2019 Barabeisch et al.
2019/0020202 A1 1/2019 Wan
2019/0357741 A1 11/2019 Conrad
2020/0260924 A1 8/2020 Conrad
2020/0260925 A1 8/2020 Conrad
2020/0260926 A1 8/2020 Conrad
2020/0274376 A1 8/2020 Conrad
2021/0091641 A1 3/2021 Hatakeyama et al.

FOREIGN PATENT DOCUMENTS

CA 1218962 A 3/1987
CA 2450450 A1 12/2004
CA 2484587 A1 4/2005
CA 2438079 C 8/2009
CA 2659212 A1 9/2010
CN 1493244 A 5/2004
CN 1887437 A 1/2007
CN 202932850 U 5/2013
CN 107105951 A 8/2017
CN 108283459 A 7/2018
DE 875134 C 4/1953
DE 9216071 U1 2/1993
DE 4232382 C1 3/1994
EP 493950 A2 7/1992
EP 1200196 B1 6/2005
EP 1779761 A2 5/2007
EP 1815777 A1 8/2007
EP 1594386 B1 4/2009
EP 1676516 B1 1/2010
EP 2308360 A2 4/2011
EP 1629758 B1 10/2013
EP 2848173 A1 3/2015
FR 2812531 B1 11/2004
GB 700791 A 12/1953
GB 1111074 A 4/1968
GB 2035787 B 10/1982
GB 2126471 B 11/1985
GB 2163703 B 1/1988
GB 2268875 A 1/1994
GB 2307849 A 6/1997
GB 2282979 B 10/1997
GB 2365324 B 7/2002
GB 2441962 B 3/2011
GB 2466290 B 10/2012
GB 2508035 A 5/2014
JP 61131720 A 6/1986
JP 2000140533 A 5/2000
JP 2010178773 A 8/2010
JP 2010220632 A 10/2010
JP 2011189132 A 9/2011
JP 2011189133 A 9/2011
WO 1980002561 A1 11/1980

(56) References Cited

FOREIGN PATENT DOCUMENTS

| | | | |
|---|---|---|---|
| WO | 9627446 | A1 | 9/1996 |
| WO | 9720492 | A1 | 6/1997 |
| WO | 9809121 | A1 | 3/1998 |
| WO | 9843721 | A1 | 10/1998 |
| WO | 0107168 | A1 | 2/2001 |
| WO | 2004069021 | A1 | 8/2004 |
| WO | 2005/084511 | A1 | 9/2005 |
| WO | 2006026414 | A3 | 8/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008088278 | A2 | 7/2008 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | a | 12/2010 |
| WO | 2011054106 | A1 | 5/2011 |
| WO | 2012042240 | A1 | 4/2012 |
| WO | 2012117231 | A1 | 9/2012 |

OTHER PUBLICATIONS

Makita 4071 Handy Vac II Cordless Cleaner, dated as early as Oct. 1993.

Handbook of Air Pollution Prevention and Control, pp. 397-404, 2002.

International Search Report and Written Opinion received in connection to international patent application No. PCT/CA2020/050158, dated Apr. 15, 2020.

International Preliminary Report on Patentability, received in connection to international Patent application No. PCT/CA2020/050158, dated Aug. 10, 2021.

English machine translation of CN107105951A, published on Aug. 29, 2017.

English machine translation of CN108283459A, published on Jul. 17, 2018.

English machine translation of JP61131720A, published on Jun. 19, 1986.

TotalPatent One: English machine translation of CN202932850, published on May 15, 2013.

* cited by examiner

SURFACE CLEANING APPARATUS HAVING AN ENERGY STORAGE MEMBER AND A CHARGER FOR AN ENERGY STORAGE MEMBER

CROSS-REFERENCE TO RELATED APPLICATIONS

This application is a continuation of U.S. patent application Ser. No. 16/280,930, filed on Feb. 20, 2019, and it is:

a continuation-in-part of U.S. patent application Ser. No, 17/458,195, filed on Aug. 26, 2021, which itself is a continuation in part of co-pending U.S. patent application Ser. No. 16/270,693, filed on Feb. 8, 2019 and issued as U.S. Pat. No. 11,202,539 on Dec. 21, 2021, which is a continuation of U.S. patent application Ser. No. 15/095,941, filed on Apr. 11, 2016 and issued as U.S. Pat. No. 10,258,208 on Apr. 16, 2019; and it is a continuation-in-part of U.S. patent application Ser. No, 17/403,729, filed on Aug. 16, 2021, which itself is a continuation of U.S. patent application Ser. No. 16/182,947, filed on Nov. 7, 2018 and issued as U.S. Pat. No. 11,122,943 on Sep. 21, 2021, which itself is a continuation of U.S. patent application Ser. No, 15/076,060, filed on Mar. 21, 2016 and issued as U.S. Pat. No. 10,165,912 on Jan. 1, 2019, which itself is:

(a) a continuation-in-part of co-pending U.S. patent application Ser. No. 14/822,211, filed on Aug. 10, 2015 and issued as U.S. Pat. No. 9,888,817 on Feb. 13, 2018, which itself claims priority from U.S. Provisional Patent Application 62/093,189, filed on Dec. 17, 2014;

(b) a continuation-in-part of co-pending U.S. patent application Ser. No. 14/875,381, filed on Oct. 5, 2015 and issued as U.S. Pat. No. 9,545,181 on Jan. 17, 2017; which itself is continuation of co-pending U.S. patent application Ser. No. 13/782,217 filed on Mar. 1, 2013 and issued as U.S. Pat. No. 9,192,269 on Nov. 24, 2015; which itself is a continuation-in-part of co-pending U.S. patent application Ser. No. 13/720,754, filed on Dec. 19, 2012 and issued as U.S. Pat. No. 8,752,239 on Jun. 17, 2014; which itself is a divisional application of co-pending U.S. patent application Ser. No. 11/954,331, filed on Dec. 12, 2007 and issued as U.S. Pat. No. 8,359,705 on Jan. 29, 2013, which itself claims priority from U.S. Provisional Patent applications 60/870,175 (filed on Dec. 15, 2006), and 60/884,767 (filed on Jan. 12, 2007), the content of each of which is incorporated herein in its entirety by reference.

FIELD

This application relates to the field of surface cleaning apparatus operable on an energy storage member, chargers for an energy storage member and a surface cleaning apparatus having an on board charger for an energy storage member.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners, including battery operated cyclonic hand vacuum cleaners, are known in the art.

Battery operated vacuum cleaners are known. For Example, Best (U.S. Pat. No. 7,377,007) discloses an upright vacuum cleaner having a detachable vacuum module wherein the detachable vacuum module may have an on board battery. A charger may be provided in the surface cleaning head or the detachable vacuum module. Accordingly, when the on board battery requires recharging, the on board charger may be used to recharge the battery. Alternately, the battery charger may be provided in a docking station and the battery recharged when the upright vacuum cleaner is placed in the docking station.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In accordance with a first aspect, which may be used by itself or with any one or more other aspects set out herein, an energy storage member charger, such as a battery charger, may have its own on board energy storage member. Accordingly, when another energy storage member that is external to the charger (e.g., an energy storage member for a surface cleaning apparatus) needs charging, the energy storage member in the charger may be used to charge the energy storage member of the surface cleaning apparatus by itself or concurrently with power drawn, e.g., from a stationary source of power such as a household electrical outlet. The energy storage member of the energy storage member charger may hold sufficient charge to charge the external energy storage member at least twice and optionally 3, 4, 5, 6 or more times. Using a charger having an on board energy storage member, a user may be able to recharge an energy storage member of a surface cleaning apparatus at a rate of 2 C, 3 C, 4 C, 5 C, 6 C or more.

In a particular embodiment of this aspect, the energy storage member of the portable surface cleaning apparatus comprises or consists of one or more capacitors such as an ultra-capacitor.

An advantage of this design is that a user may be able to clean an entire household without any breaks or with fewer and/or shorter breaks. For example, current domestic upright or stick type vacuum cleaners may need 6-8 or more hours to fully recharge a battery pack. Accordingly, once a battery pack is depleted, a user may have to wait overnight to finish cleaning a household. In contrast, in accordance with this design, a surface cleaning apparatus comprises a floor cleaning module and a portable surface cleaning unit (e.g., a lift away module or a hand vac) that has an on board energy storage member. A user may use the portable surface cleaning unit to clean part of a household (e.g., furniture). Once that part is cleaned or when the on board energy storage member is depleted, the portable surface cleaning unit may be mounted on the floor cleaning unit. The floor cleaning unit may then be operated on power drawn from a household electrical outlet (e.g., the surface cleaning apparatus may have an electric cord). While the user is cleaning the floor, the energy storage member of the portable surface cleaning unit may be recharged in, e.g., 1-15 minutes, 2-12 minutes, 3-10 minutes 4-7 minutes, about 5 minutes or any desired time frame less than 15 minutes. Accordingly, by the time a user needs to again use the portable surface cleaning unit, the energy storage member of the portable surface cleaning unit may be fully charged. Accordingly, this aspect allows a user to continuously use the surface cleaning apparatus in a floor cleaning and an above floor cleaning mode.

In accordance with this aspect, there is provide a surface cleaning apparatus comprising:

(a) a floor cleaning unit comprising:
  (i) a surface cleaning head having a front end having a dirty air inlet, a rear end and a center positioned midway between the front and rear ends;
  (ii) an upper section moveably mounted to the surface cleaning head between an upright storage position and a rearwardly inclined floor cleaning position;
  (iii) a charger having an energy storage member; and,
  (iv) an air flow path extending from the dirty air inlet to a floor cleaning unit air outlet; and, (b) a portable surface cleaning unit connectable to the floor cleaning unit, the portable surface cleaning unit comprising a portable surface cleaning unit air inlet connectable in air flow communication with the floor cleaning unit air outlet, a main body, an air treatment member, a suction motor, a handle and a capacitor, wherein, when fully charged, the energy storage member stores sufficient stored power to recharge the capacitor at least twice.

In any embodiment, the suction motor may not be operable directly on power supplied by the energy storage member.

In any embodiment, the suction motor may be operable only from:

(a) power supplied from the capacitor, or (b) the surface cleaning apparatus may further comprise an electrical cord connectable with a stationary source of power and the suction motor is operable from power supplied from the capacitor and power supplied from a stationary power supply.

In any embodiment, the energy storage member may be provided in the surface cleaning head and, optionally, in a forward portion of the surface cleaning head (e.g., at a location forward of the portable surface cleaning unit such as adjacent the dirty air inlet).

In any embodiment, the energy storage member may have a center of gravity and the center of gravity may be positioned forward of the center of the surface cleaning head.

In any embodiment, the floor cleaning unit may further comprise a thermal cooling unit thermally connected to the charger.

In any embodiment, the charger may be operable to recharge the capacitor at a rate of at least 4 C or at least 6 C.

In any embodiment, the capacitor may comprise an ultra-capacitor.

In any embodiment, the surface cleaning apparatus may further comprise an electrical cord connectable with a stationary source of power.

In any embodiment, the portable cleaning unit may further comprise an electrical cord connectable with a stationary source of power. The electrical cord may be removably connectable with the portable cleaning unit.

In any embodiment, the capacitor may be removably mounted in the portable surface cleaning unit.

In any embodiment, the portable surface cleaning unit may comprise a hand vacuum cleaner and the upper section may comprise a rigid air flow conduit having an upper end and a lower end, wherein the lower end of the rigid air flow conduit is moveably mounted to the surface cleaning head between the upright storage position and the rearwardly inclined floor cleaning position, and wherein the hand vacuum cleaner is connectable to the upper end of the rigid air flow conduit, whereby, when the hand vacuum cleaner is connected to the upper end of the rigid air flow conduit the handle is a steering handle for the vacuum cleaner.

In accordance with another aspect, which may be used by itself or with any one or more other aspects set out herein, a surface cleaning apparatus comprises a floor cleaning module and a portable surface cleaning unit that has an on board energy storage member that optionally comprises or consists of one or more capacitors such as an ultra-capacitor. The surface cleaning head is provided with a charger whereby the on board energy storage member may be charged at a rate of 2 C, 3 C, 4 C, 5 C, 6 C or more. As discussed previously, an advantage of this aspect is that a user may be able to continuously, or more continuously clean a household without downtime while an on board energy storage member is recharged.

In accordance with this aspect, there is provided a vacuum cleaner comprising:

(a) a floor cleaning unit comprising:
  (i) a surface cleaning head having a front end having a dirty air inlet, a rear end, a center positioned midway between the front and rear ends and a charger;
  (ii) an upper section moveably mounted to the surface cleaning head between an upright storage position and a rearwardly inclined floor cleaning position; and,
  (iii) an air flow path extending from the dirty air inlet to a floor cleaning unit air outlet; and, (b) a portable surface cleaning unit removably mounted to the upper section, the portable surface cleaning unit comprising a main body, an air treatment member, a suction motor, a handle and a capacitor, wherein, the portable surface cleaning unit is rechargeable when mounted to the floor cleaning unit and, wherein the capacitor is rechargeable at a rate of at least 4 C.

In any embodiment, the suction motor may be operable only from:

(a) power supplied from the capacitor, or (b) the surface cleaning apparatus may further comprise an electrical cord connectable with a stationary source of power and the suction motor is operable from power supplied from the capacitor and power supplied from a stationary power supply.

In any embodiment, the energy storage member may have a center of gravity and the center of gravity is positioned forward of the center of the surface cleaning head. The center of gravity may be positioned at the front end of the surface cleaning head.

In any embodiment, the capacitor may comprise an ultra-capacitor.

In any embodiment, the portable surface cleaning unit may comprise a hand vacuum cleaner and the upper section may comprise a rigid air flow conduit having an upper end and a lower end, wherein the lower end of the rigid air flow conduit is moveably mounted to the surface cleaning head between the upright storage position and the rearwardly inclined floor cleaning position, and wherein the hand vacuum cleaner is connectable to the upper end of the rigid air flow conduit, whereby, when the hand vacuum cleaner is connected to the upper end of the rigid air flow conduit the handle is a steering handle for the vacuum cleaner.

In any embodiment, the portable cleaning unit may further comprise an electrical cord connectable with a stationary source of power.

In any embodiment, the energy storage member may store sufficient stored power to recharge the capacitor at least twice.

In any embodiment, the floor cleaning unit may further comprise a thermal cooling unit thermally connected to the charger.

In accordance with this aspect, there is also provided a vacuum cleaner comprising:

(a) a floor cleaning unit comprising:

(i) a surface cleaning head having a front end having a dirty air inlet, a rear end, a center positioned midway between the front and rear ends and a charger;

(ii) an upper section moveably mounted to the surface cleaning head between an upright storage position and a rearwardly inclined floor cleaning position; and, (iii) an air flow path extending from the dirty air inlet to a floor cleaning unit air outlet; and, (b) a portable surface cleaning unit removably mounted to the upper section, the portable surface cleaning unit comprising a main body, an air treatment member, a suction motor, a handle and a capacitor, wherein, the portable surface cleaning unit is rechargeable when mounted to the floor cleaning unit, and wherein the energy storage member has a center of gravity and the center of gravity is positioned forward of the center of the surface cleaning head.

In any embodiment, the suction motor may be operable only from:

(c) power supplied from the capacitor, or (d) the surface cleaning apparatus may further comprise an electrical cord connectable with a stationary source of power and the suction motor is operable from power supplied from the capacitor and power supplied from a stationary power supply.

In any embodiment, the center of gravity may be positioned at the front end of the surface cleaning head.

In any embodiment, the capacitor may comprise an ultracapacitor.

In any embodiment, the portable surface cleaning unit may comprise a hand vacuum cleaner and the upper section may comprise a rigid air flow conduit having an upper end and a lower end, wherein the lower end of the rigid air flow conduit is moveably mounted to the surface cleaning head between the upright storage position and the rearwardly inclined floor cleaning position, and wherein the hand vacuum cleaner is connectable to the upper end of the rigid air flow conduit, whereby, when the hand vacuum cleaner is connected to the upper end of the rigid air flow conduit the handle is a steering handle for the vacuum cleaner.

In such a surface cleaning apparatus, the portable cleaning unit may further comprise an electrical cord connectable with a stationary source of power. The suction motor may be operable only from:

(a) power supplied from the capacitor, or (b) the surface cleaning apparatus may further comprise an electrical cord connectable with a stationary source of power and the suction motor is operable from power supplied from the capacitor and power supplied from a stationary power supply.

In any embodiment, the energy storage member may store sufficient stored power to recharge the capacitor at least twice or at least three times.

In any embodiment, the floor cleaning unit may further comprise a thermal cooling unit thermally connected to the charger.

In accordance with another aspect, which may be used by itself or with any one or more other aspects set out herein, the charger may be remote from the surface cleaning apparatus. An advantage of this design is that the surface cleaning apparatus may be lighter. This may be preferred for the elderly or those with a physical disability. In particular, such a design may be used for embodiments wherein the charger includes a thermal cooling member.

In accordance with this aspect, there is provided a surface cleaning apparatus kit comprising:

(a) a surface cleaning apparatus comprising:

(i) floor cleaning unit comprising a surface cleaning head and a rigid air flow conduit having an upper end and a lower end moveably mounted to the surface cleaning head between an upright storage position and a rearwardly inclined floor cleaning position; and, (ii) a portable surface cleaning unit removably mounted to the rigid air flow conduit, the portable surface cleaning unit comprising a main body, an air treatment member, a suction motor, a handle and a capacitor; and, (b) a charger positionable remote from the surface cleaning apparatus and electrically connectable to a stationary power supply, wherein, when the capacitor is electrically connected to the charger, the capacitor is recharged at a rate of at least 4 C.

In any embodiment, the capacitor may comprise an ultracapacitor.

In any embodiment, the charger may be operable to recharge the capacitor at a rate of at least 6 C.

In any embodiment, the surface cleaning apparatus kit may further comprise a thermal cooling unit thermally connected to the charger.

In any embodiment, the capacitor may be removably mounted to the portable surface cleaning unit.

In any embodiment, the portable cleaning unit may further comprise an electrical cord connectable with a stationary source of power.

In any embodiment, the electrical cord may be removably connectable with the portable surface cleaning unit.

In any embodiment, the portable cleaning unit may further comprise an electrical cord connectable with the charger. The electrical cord may be removably connectable with the portable surface cleaning unit.

In accordance with this aspect, there is also provided a surface cleaning apparatus kit comprising:

(a) a surface cleaning apparatus comprising:

(i) floor cleaning unit comprising a surface cleaning head and a rigid air flow conduit having an upper end and a lower end moveably mounted to the surface cleaning head between an upright storage position and a rearwardly inclined floor cleaning position; and, (ii) a portable surface cleaning unit removably mounted to the rigid air flow conduit, the portable surface cleaning unit comprising a main body, an air treatment member, a suction motor, a handle and a capacitor;

(b) a charger positionable remote from the surface cleaning apparatus and electrically connectable to a stationary power supply; and, (c) a thermal cooling unit thermally connected to the charger.

In any embodiment, the capacitor may comprise an ultra-capacitor.

In any embodiment, the charger may be operable to recharge the capacitor at a rate of at least 6 C.

In any embodiment, the thermal cooling unit may comprise a liquid heat sink.

In any embodiment, the capacitor may be removably mounted to the portable surface cleaning unit.

In any embodiment, the portable cleaning unit may further comprise an electrical cord connectable with a stationary source of power. The electrical cord may be removably connectable with the portable surface cleaning unit.

In any embodiment, the portable cleaning unit may further comprise an electrical cord connectable with the charger. The electrical cord may be removably connectable with the portable surface cleaning unit.

As discussed with respect to previous aspects, a user may be able to clean continuously or more continuously using any of the aspects set out herein. Accordingly, there is provided a method of cleaning a surface using a stick vacuum cleaner, the stick vacuum cleaner comprising:

(a) a floor cleaning unit comprising:

(i) a surface cleaning head having a front end having a dirty air inlet and a rear end;

(ii) a rigid air flow conduit having an upper end and a lower end moveably mounted to the surface cleaning head between an upright storage position and a rearwardly inclined floor cleaning position; and, (iii) an air flow path extending from the dirty air inlet to a rigid air flow conduit air outlet; and, (b) a hand vacuum cleaner removably mounted to the upper end of the rigid air flow conduit, the hand vacuum cleaner comprising a main body, an air treatment member, a suction motor, a handle and a capacitor, the method comprising:

(a) removing the hand vacuum cleaner from the upper end of the rigid air flow conduit and using the portable cleaning unit to clean a surface;

(b) subsequently mounting the hand vacuum cleaner on the upper end of the rigid air flow conduit and using the stick vacuum cleaner to clean a floor for up to 15 minutes while the capacitor at least substantially recharges; and, (c) subsequently removing the hand vacuum cleaner from the upper end of the rigid air flow conduit and using the hand vacuum cleaner to clean a surface.

In any embodiment, step (b) may comprise using the stick vacuum cleaner to clean the floor for up to 5, 6, 7, 8, 9, 120, 11, 12, 13, 14 or 15 minutes while the capacitor substantially or fully recharges.

In any embodiment, the floor cleaning unit may further comprise a charger having an energy storage member, wherein, when fully charged, the energy storage member stores sufficient stored power to recharge the capacitor at least twice, and step (b) may comprise using the energy storage member to recharge the capacitor.

There is also provided a method of cleaning a surface using a surface cleaning apparatus, the surface cleaning apparatus comprising:

(a) a floor cleaning unit comprising a surface cleaning head and a rigid air flow conduit having an upper end and a lower end moveably mounted to the surface cleaning head between an upright storage position and a rearwardly inclined floor cleaning position; and, (b) a portable surface cleaning unit removably mounted to the rigid air flow conduit, the portable surface cleaning unit comprising a main body, an air treatment member, a suction motor, a handle and a capacitor, the method comprising:

(a) removing the portable cleaning unit from the floor cleaning unit and using the portable cleaning unit to clean a surface;

(b) subsequently mounting the portable cleaning unit on the floor cleaning unit and using the surface cleaning apparatus to clean a floor for up to 15 minutes while the capacitor at least substantially recharges; and, (c) subsequently removing the portable cleaning unit from the floor cleaning unit and using the portable cleaning unit to clean a surface.

In any embodiment, step (b) may comprise using the stick vacuum cleaner to clean the floor for up to 5, 6, 7, 8, 9, 120, 11, 12, 13, 14 or 15 minutes while the capacitor substantially or fully recharges.

In any embodiment, the floor cleaning unit may further comprise a charger having an energy storage member, wherein, when fully charged, the energy storage member stores sufficient stored power to recharge the capacitor at least twice, and step (b) may comprise using the energy storage member to recharge the capacitor.

The method may be conducted using a stick vacuum cleaner comprising:

(a) a surface cleaning head;

(b) a rigid air flow conduit having an upper end and a lower end moveably mounted to the surface cleaning head between an upright storage position and a rearwardly inclined floor cleaning position; and, (c) a hand vacuum cleaner removably mounted to the upper end of the rigid air flow conduit, the hand vacuum cleaner comprising a main body, an air treatment member, a suction motor, a handle, a capacitor and an electrical cord connectable with a stationary source of power, wherein, when the portable surface cleaning unit is mounted to the upper end of the rigid air flow conduit, the handle is a steering handle for the vacuum cleaner.

In any embodiment, the electrical cord may be removably connectable with the hand vacuum cleaner.

In any embodiment, the capacitor may be removaby mounted to the hand vacuum cleaner.

In any embodiment, the capacitor may be an ultra-capacitor.

It will be appreciated that one or more of these aspects may be used with outer household self-powered appliances such as power tools, kitchen appliances, personal appliances and the like.

DRAWINGS

For a better understanding of the described embodiments and to show more clearly how they may be carried into effect, reference will now be made, by way of example, to the accompanying drawings in which.

DESCRIPTION OF VARIOUS EMBODIMENTS

Figure 1:
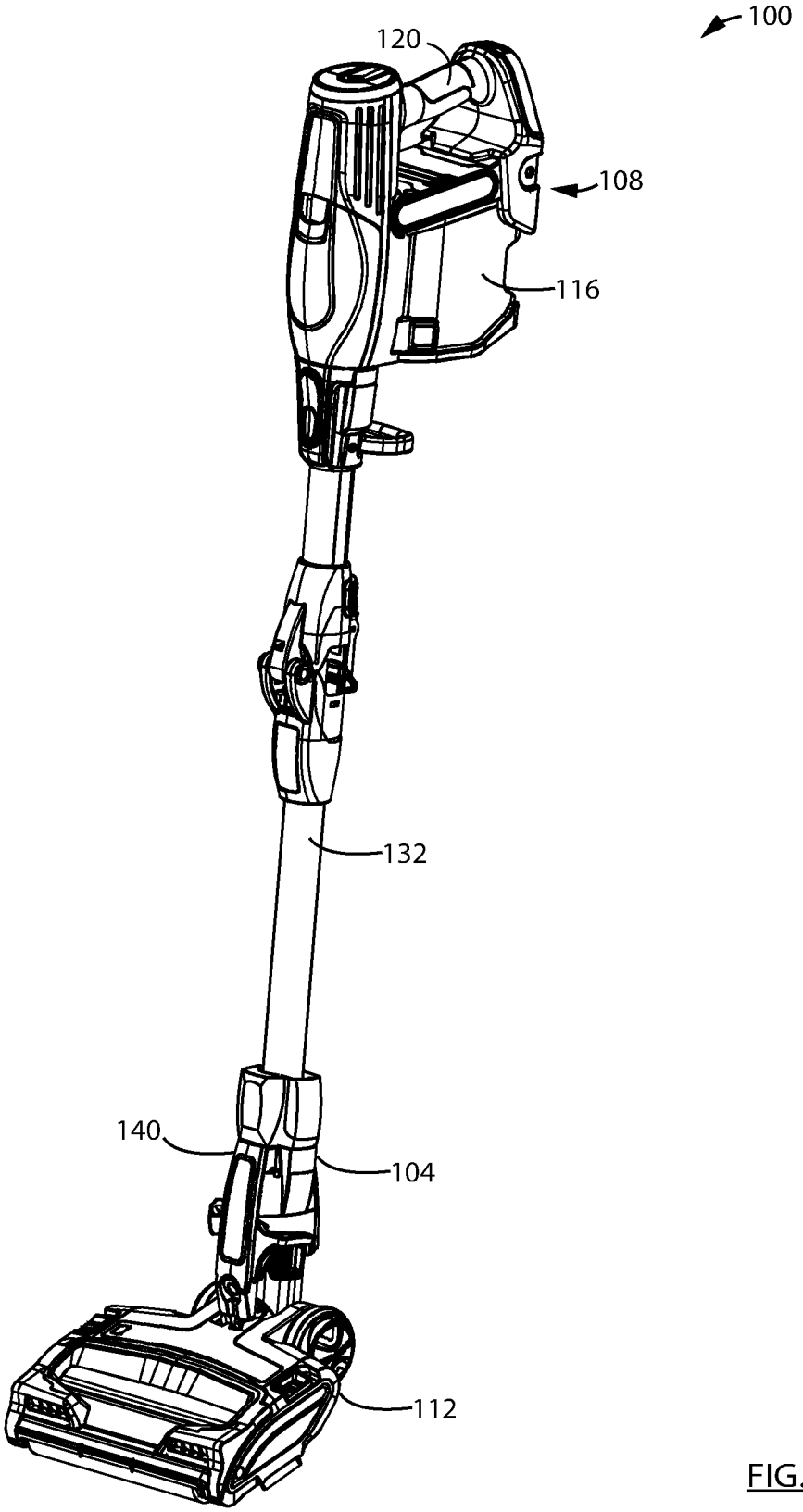
FIG. 1 is a perspective view of a surface cleaning apparatus in accordance with an embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

General Description of a Hand Vacuum Cleaner

Referring to FIGS. 1-6, exemplary embodiments of a surface cleaning apparatus are shown generally as 100. The following is a general discussion of apparatus 100 which provides a basis for understanding several of the features which are discussed herein. As discussed subsequently, each of the features may be used individually or in any particular combination or sub-combination in this or in other embodiments disclosed herein.

Figure 5:
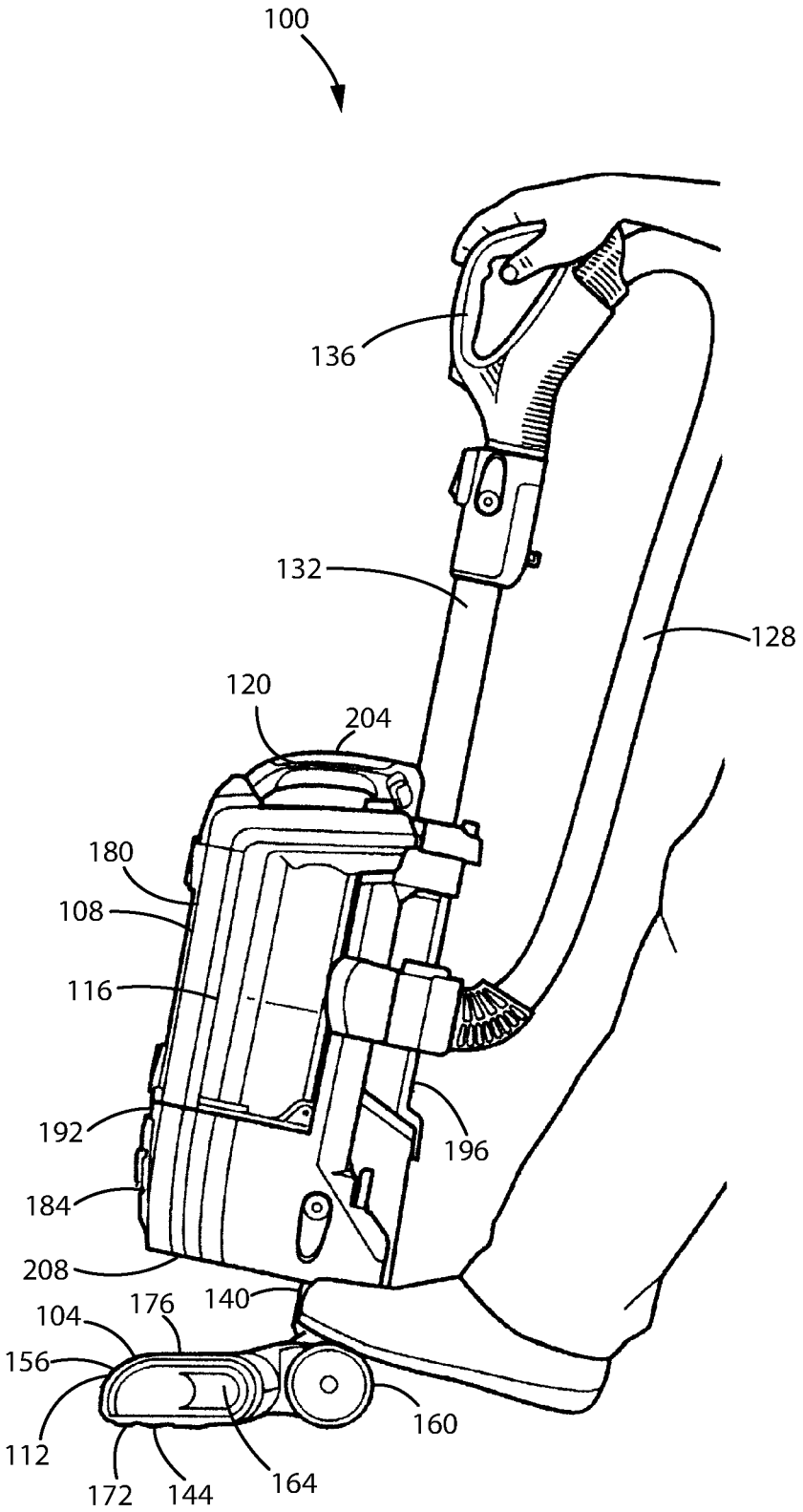
FIG. 5 is a perspective view of a surface cleaning apparatus in accordance with another embodiment.

Surface cleaning apparatus 100 may be any type of surface cleaning apparatus, including for example a stick vacuum cleaner as shown in FIG. 1, an upright vacuum cleaner as shown in FIG. 5, a canister vacuum cleaner, an extractor or a wet/dry type vacuum cleaner. Optionally, the surface cleaning apparatus 100 may use one or more cyclones and may therefore be a cyclonic surface cleaning apparatus.

In FIGS. 1-6, surface cleaning apparatus 100 is illustrated as including a floor cleaning unit 104, and a portable surface cleaning unit 108 that is connectable to the floor cleaning unit 104. The floor cleaning unit 104 may include a surface cleaning head 112 adapted to clean floors. Portable surface cleaning unit 108 may include an air treatment member 116. Surface cleaning apparatus 100 may include an upright configuration (also referred to as a 'floor cleaning configuration', see FIGS. 1 and 5) in which portable surface cleaning unit 108 is mounted to floor cleaning unit 104, and dirty air that enters the surface cleaning head 112 flows downstream to portable surface cleaning unit 108 where the dirty air is cleaned by air treatment member 116. Surface cleaning apparatus 100 may also include a 'portable cleaning configuration' (also referred to as a 'hand carriable configuration', or 'above-floor cleaning configuration', see FIGS. 3 and 6), in which portable surface cleaning unit 108 is separated from floor cleaning unit 104, such as to clean above-floor surfaces and surfaces generally inaccessible to or unsuitable for cleaning with surface cleaning head 112 for example.

In the embodiment of FIGS. 1-4, surface cleaning apparatus 100 is illustrated as a stick vacuum cleaner, which may also be referred to as a "stickvac". As used herein and in the claims, a stick vacuum cleaner is one in which portable surface cleaning unit 108 is a hand vacuum cleaner, which may also be referred to also as a "handvac" or "hand-held vacuum cleaner". As used herein and in the claims, a hand vacuum cleaner is a vacuum cleaner that can be operated to clean a surface generally one-handedly. That is, the entire weight of the hand vacuum cleaner may be held by the same one hand used to direct a dirty air inlet of the hand vacuum cleaner with respect to a surface to be cleaned. For example, handle 120 and dirty air inlet 124 may be rigidly coupled to each other (directly or indirectly), such as being integrally formed or separately molded and then non-removably secured together such as by an adhesive or welding, so as to move as one while maintaining a constant orientation relative to each other. This is to be contrasted with canister and upright vacuum cleaners, whose weight is typically supported by a surface (e.g. a floor) during use.

Figure 6:
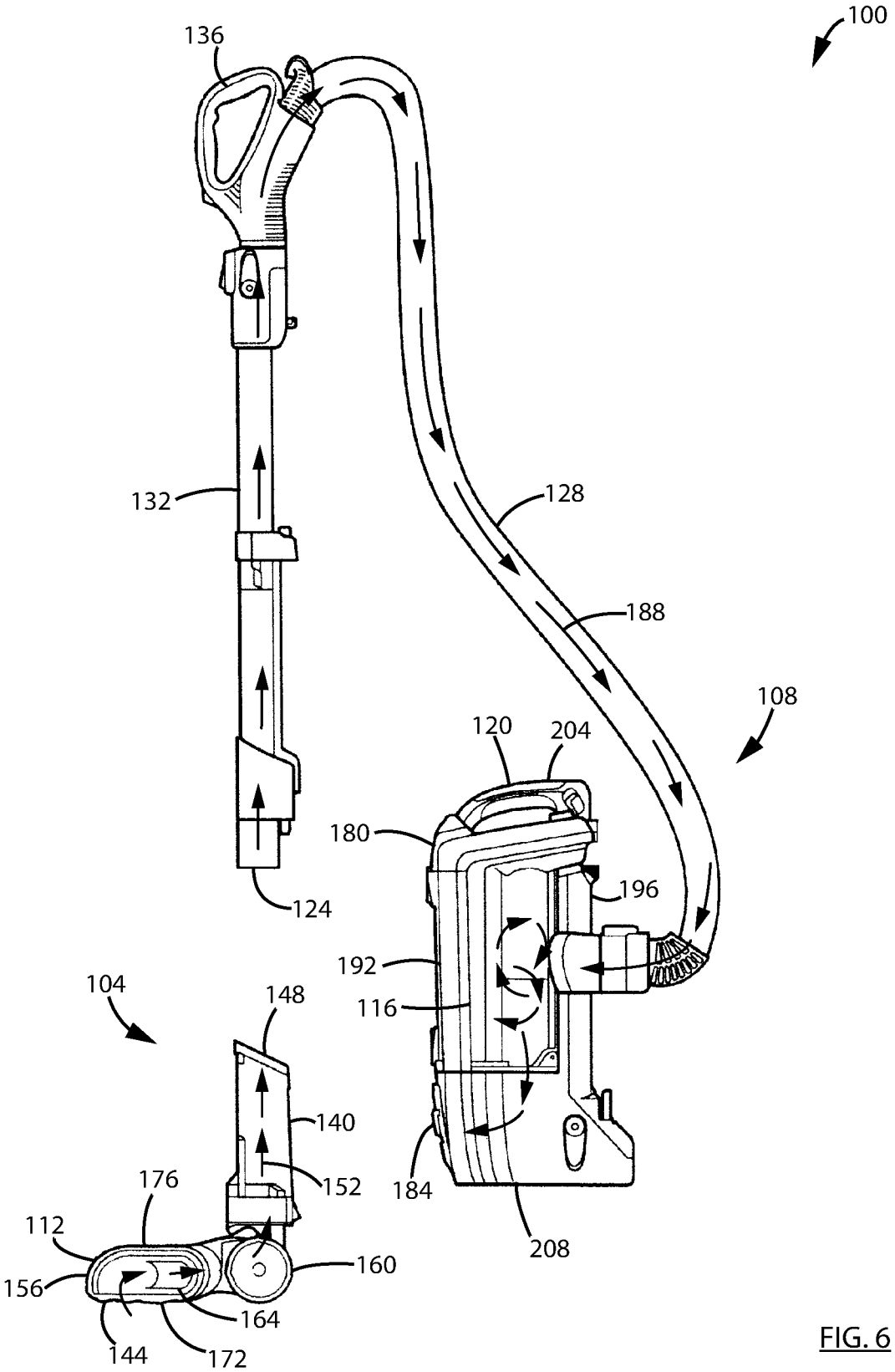
FIG. 6 is an exploded view of the surface cleaning apparatus of FIG. 5.

In the embodiment of FIGS. 5-6, surface cleaning apparatus 100 is illustrated as a convertible upright vacuum, in which portable surface cleaning unit 108 is a 'lift away' pod that, in the portable cleaning configuration, can be hand carried by handle 120. As opposed to a hand vacuum cleaner, a lift-away pod typically uses a flexible hose to deliver air for treatment to the air inlet provided in the casing of the lift-away pod. As shown, portable surface cleaning unit 108 may include a dirty air inlet 124 upstream of a flexible hose 128. For example, dirty air inlet 124 may be located at an upstream end of a rigid conduit 132 (e.g. a wand). The user may manipulate rigid conduit 132 to position dirty air inlet 124 on or adjacent a surface (e.g. above-floor surface) to be cleaned. Optionally, rigid conduit 132 may include a handle 136 for the user to grasp while manipulating rigid conduit 132.

Referring again to FIGS. 1-6, floor cleaning unit 104 may include surface cleaning head 112, an upper section 140, a dirty air inlet 144, an air outlet 148, and an air flow path 152 extending from dirty air inlet 144 to air outlet 148. As shown, surface cleaning head 112 may include a front end 156 opposed to a rear end 160, opposed sides 164 and 168, and a lower end 172 opposed to an upper end 176. Dirty air inlet 144 may be located on lower end 172. For example, dirty air inlet 144 may be provide at front end 156. Alternatively or in addition, dirty air inlet may be provided at rear end 160, or intermediate front and rear ends 156, 160.

Upper section 140 may be movably mounted to surface cleaning head 112 in a manner that allows upper section 140 to move between an upright storage position (e.g. FIG. 1), and an inclined floor cleaning position (e.g. FIG. 5). For example, upper section 140 may have a rotating connection to surface cleaning head 112 that allows upper section 140 to rotate between the upright storage and inclined floor cleaning positions.

As shown in FIGS. 1-4, the portable surface cleaning unit 108 is a hand vacuum cleaner and in FIGS. 5-6, the portable surface cleaning unit 108 is a lift-away pod. Accordingly, the description of apparatus 100 and portable surface cleaning unit 108 below makes frequent reference to figures showing embodiments in which portable surface cleaning unit 108 is illustrated as a hand vacuum, similar to FIGS. 1-4. To be clear and concise and avoid duplication, the description may not reference a lift-way pod version which has an appearance similar to the embodiment of FIGS. 5-6. However, it is expressly contemplated, and will be readily understood by persons skilled in the art, that the features described with reference to hand vacuum cleaners similar to the embodiment of FIGS. 1-4 also apply mutatis mutandis to embodiments with a lift-away pod similar to FIGS. 5-6, unless expressly stated otherwise.

Figure 3:
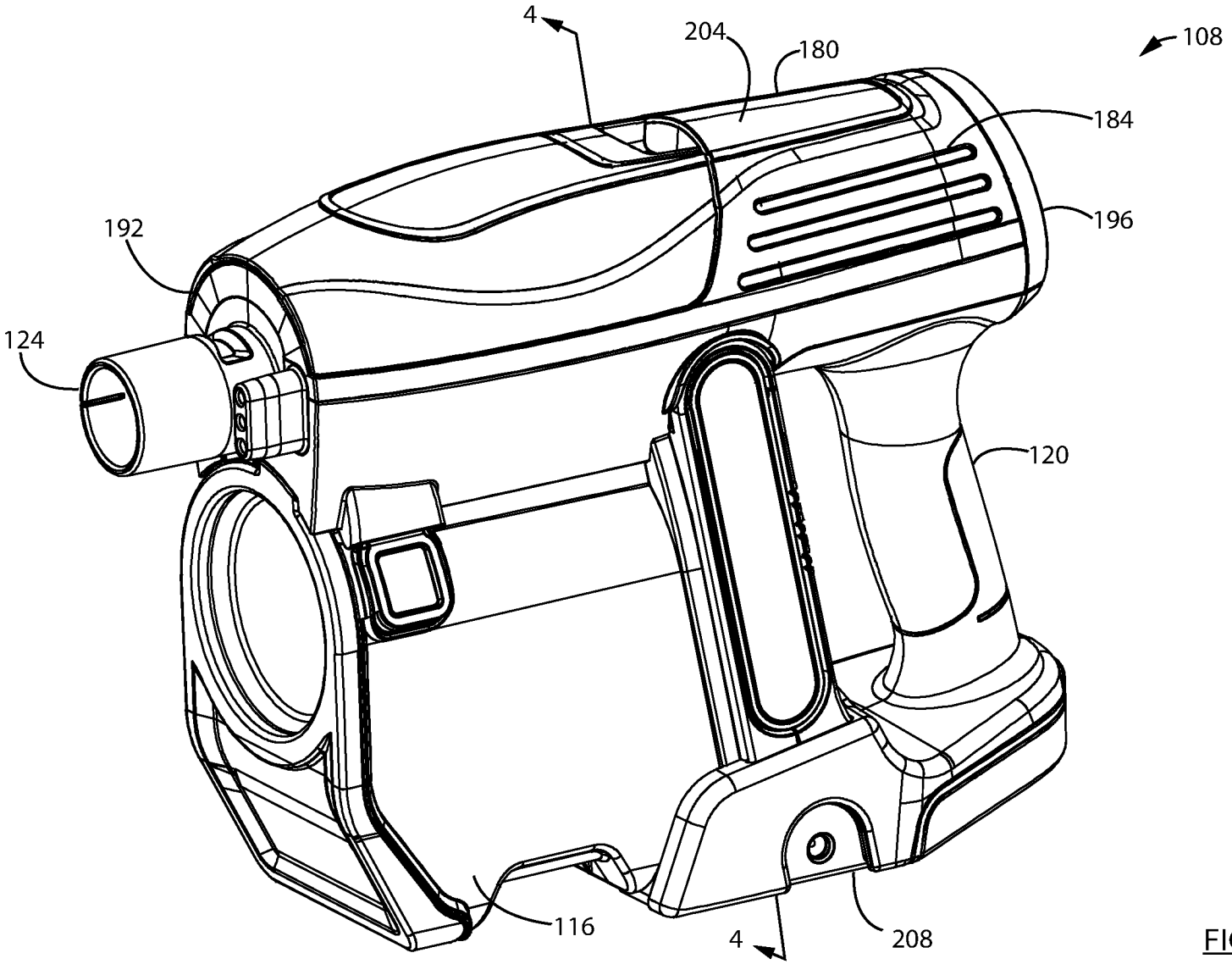
FIG. 3 is a perspective view of a portable surface cleaning unit of the surface cleaning apparatus of FIG. 1.
Figure 4:
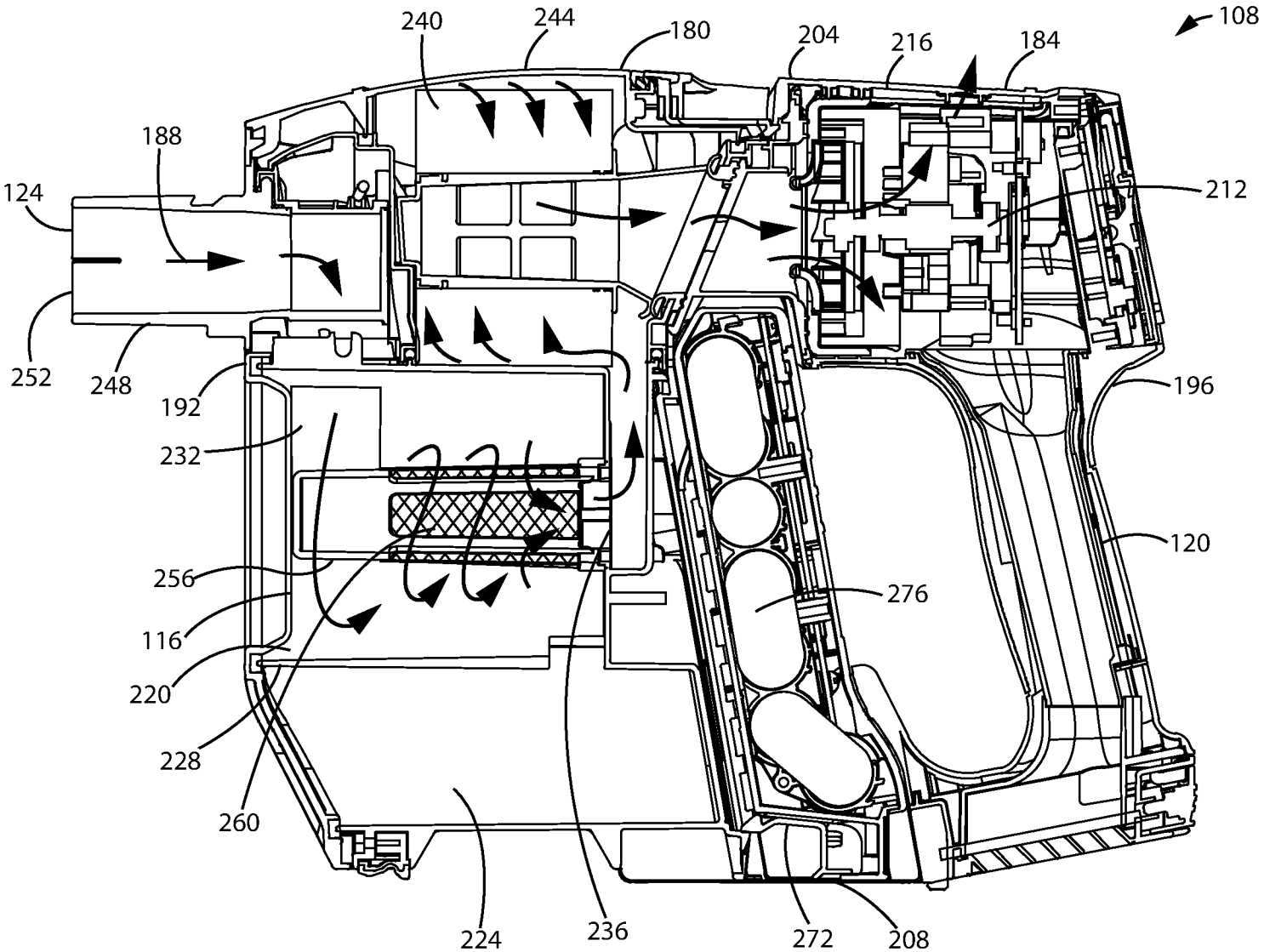
FIG. 4 is a cross-sectional view taken along line 4-4 in FIG. 3.

Referring to FIGS. 3-4, portable surface cleaning unit 108 includes a main body 180 having an air treatment member 116 (which may be permanently affixed to the main body or may be removable therefrom for emptying), a dirty air inlet 124, a clean air outlet 184, and an air flow path 188 extending between the dirty air inlet 124 and the clean air outlet 184.

Portable surface cleaning unit 108 has a front end 192, a rear end 196, an upper end (also referred to as the top) 204, and a lower end (also referred to as the bottom) 208. In the embodiment shown, dirty air inlet 124 is at an upper portion of front end 192 and clean air outlet 184 is at rear end 196. It will be appreciated that dirty air inlet 124 and clean air outlet 184 may be positioned in different locations of portable surface cleaning unit 108. For example, FIG. 6 illustrates an embodiment in which clean air outlet 184 is located at front end 192.

Turning to FIG. 4, portable surface cleaning unit 108 may include a suction motor 212 to generate vacuum suction through air flow path 188. Suction motor 212 may be positioned within a motor housing 216. Suction motor 212 may be a fan-motor assembly including an electric motor and impeller blade(s). In the illustrated embodiment, suction motor 212 is positioned in the air flow path 188 downstream of air treatment member 116. In this configuration, suction motor 212 may be referred to as a "clean air motor". Alternatively, suction motor 212 may be positioned upstream of air treatment member 116, and referred to as a "dirty air motor".

Air treatment member 116 is configured to remove particles of dirt and other debris from the air flow. In the illustrated example, air treatment member 116 includes a cyclone assembly (also referred to as a "cyclone bin assembly") having a single cyclonic cleaning stage with a single cyclone 220 and a dirt collection chamber 224 (also referred to as a "dirt collection region", "dirt collection bin", "dirt bin", or "dirt chamber"). Cyclone 220 has a cyclone chamber 228, a cyclone air inlet 232, and a cyclone air outlet 236. Dirt collection chamber 224 may be external to the cyclone chamber 228 (i.e. dirt collection chamber 224 may have a discrete volume from that of cyclone chamber 228). Cyclone 220 and dirt collection chamber 224 may be of any configuration suitable for separating dirt from an air stream and collecting the separated dirt respectively and may be in communication by a dirt outlet of the cyclone chamber.

In alternate embodiments, air treatment member 116 may include a cyclone assembly having two or more cyclonic cleaning stages arranged in series with each other. Each cyclonic cleaning stage may include one or more cyclones arranged in parallel with each other and one or more dirt collection chambers, of any suitable configuration. The dirt collection chamber(s) may be external to the cyclone chambers of the cyclones. Alternatively, one or more (or all) of the dirt collection chamber(s) may be internal to one or more (or all) of the cyclone chambers. For example, the internal dirt collection chamber(s) may be configured as a dirt collection area within the cyclone chamber.

In other embodiments, air treatment member 116 may not include a cyclonic cleaning stage. For example, air treatment member 116 may include a bag, a porous physical filter media (such as, for example foam or felt), one or more screens, or other air treating means.

Referring to FIG. 4, portable surface cleaning unit 108 may include a pre-motor filter 240 provided in the air flow path 188 downstream of air treatment member 116 and upstream of suction motor 212. Pre-motor filter 240 may be formed from any suitable physical, porous filter media (also referred to as "porous filter material"). For example, pre-motor filter 240 may be one or more of a foam filter, felt filter, HEPA filter, or other physical filter media. In some embodiments, pre-motor filter 240 may include an electrostatic filter, or the like. As shown, pre-motor filter 240 may be located in a pre-motor filter housing 244 that is external to the air treatment member 116.

In the illustrated embodiment, dirty air inlet 124 is the inlet end 252 of an air inlet conduit 248. Optionally, inlet end 252 of air inlet conduit 248 can be used as a nozzle to directly clean a surface. Alternatively, or in addition to functioning as a nozzle, air inlet conduit 248 may be connected (e.g. directly connected) to the downstream end of any suitable accessory tool such as a rigid air flow conduit (e.g., an above floor cleaning wand), a crevice tool, a mini brush, and the like. As shown, dirty air inlet 124 may be positioned forward of air treatment member 116, although this need not be the case.

In the embodiment of FIG. 4, the air treatment member comprises a cyclone 220, the air treatment air inlet is a cyclone air inlet 232, and the air treatment member air outlet is a cyclone air outlet 236. Accordingly, when operated in the portable cleaning configuration, suction motor 212 may be activated to draw dirty air into portable surface cleaning unit 108 through dirty air inlet 124. The dirty air is directed along air inlet conduit 248 to the cyclone air inlet 232. As shown, cyclone air inlet 232 may direct the dirty air flow to enter cyclone chamber 228 in a tangential direction so as to promote cyclonic action. Dirt particles and other debris may be disentrained (i.e. separated) from the dirty air flow as the dirty air flow travels from cyclone air inlet 232 to cyclone air outlet 236. The disentrained dirt particles and debris may discharge from cyclone chamber 228 through a dirt outlet into dirt collection chamber 224 external to the cyclone chamber 228, where the dirt particles and debris may be collected and stored until dirt collection chamber 224 is emptied.

Air exiting cyclone chamber 228 may pass through an outlet passage 256 located upstream of cyclone air outlet 236. Cyclone chamber outlet passage 256 may also act as a vortex finder to promote cyclonic flow within cyclone chamber 228. In some embodiments, cyclone outlet passage 256 may include a screen 260 (also referred to as a shroud) (e.g. a fine mesh screen) in the air flow path 188 to remove large dirt particles and debris, such as hair, remaining in the exiting air flow.

From cyclone air outlet 236, the air flow may be directed into pre-motor filter housing 244. The air flow may pass through pre-motor filter 240, and then exit pre-motor filter housing 244 into motor housing 216. At motor housing 216, the clean air flow may be drawn into suction motor 212 and then discharged from portable surface cleaning unit 108 through clean air outlet 184. Prior to exiting the clean air outlet 184, the treated air may pass through a post-motor filter, which may be one or more layers of filter media.

Referring to FIGS. 1-4, in the upright configuration (FIG. 1), dirty air inlet 124 of portable surface cleaning unit 108 is fluidly connected to air outlet 148 of floor cleaning unit 104, whereby air flow path 188 of portable surface cleaning unit 108 is located downstream of air flow path 152 of floor cleaning unit 104. In operation, dirty air enters dirty air inlet 144 of floor cleaning unit 104, travels along air flow path 152 to air outlet 148, and then enters portable surface cleaning unit 108 at dirty air inlet 124. From dirty air inlet 124, the dirty air flow moves through portable surface cleaning unit 108 as described above in connection with the portable cleaning configuration.

Figure 2:
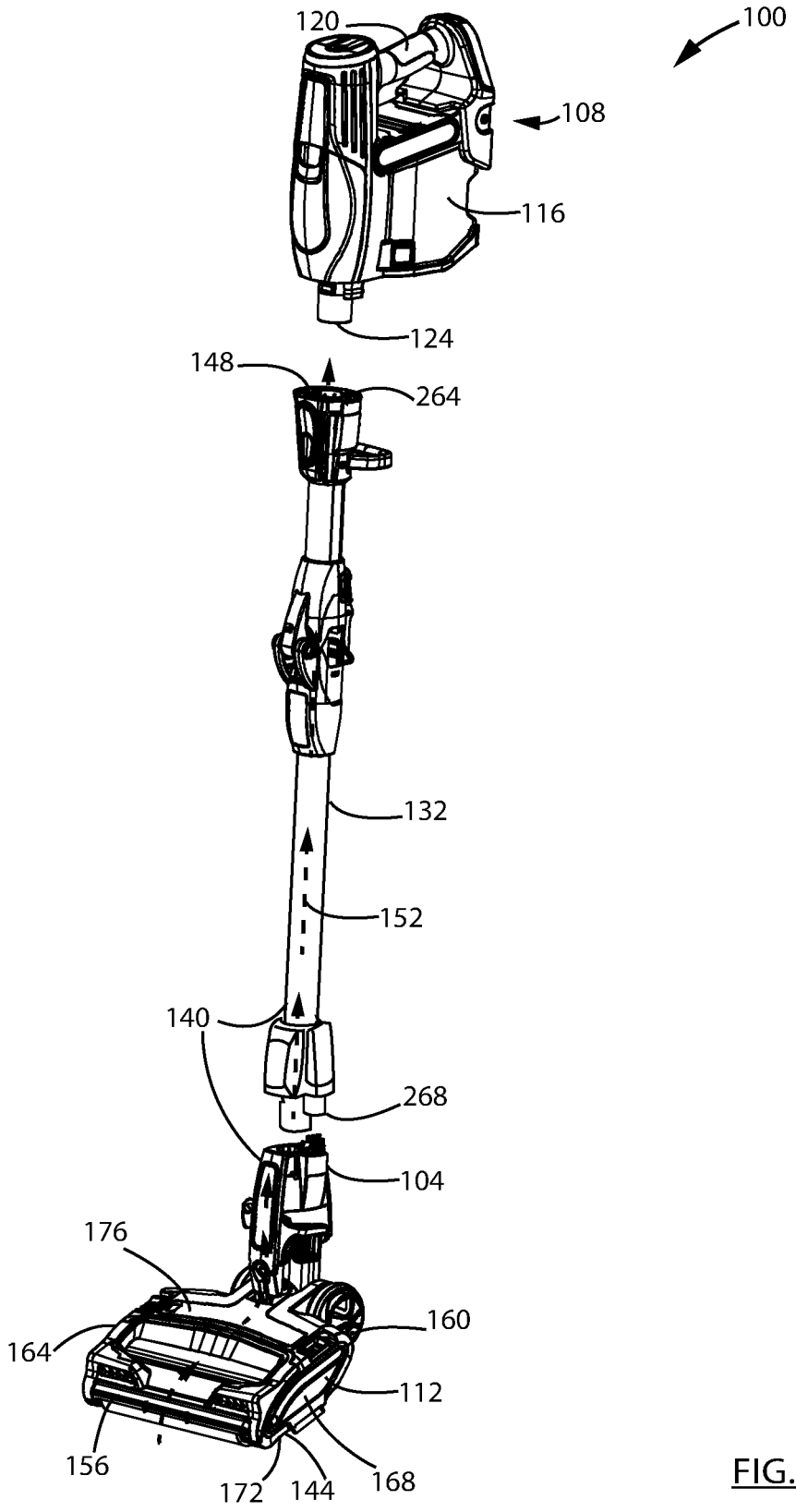
FIG. 2 is an exploded view of the surface cleaning apparatus of FIG. 1.

Referring to FIGS. 1-2, upper section 140 of floor cleaning unit 104 may include a rigid air flow conduit 132. Rigid air flow conduit 132 includes a conduit upper end 264 downstream of a conduit lower end 268. Conduit lower end 268 may be movably mounted to the surface cleaning apparatus between the upright storage position and the rearwardly inclined floor cleaning position. Portable surface cleaning unit 108 may be connected to conduit upper end 264. As shown, this allows handle 120 of handvac 108 to be used as a steering handle for stickvac 100.

Fast Charging Capacitor

A trend in cordless vacuum cleaners is to provide longer runtime in a single charge. For example, some cordless vacuum cleaners can run continuously for 30 minutes or more before recharging. However, such vacuum cleaners require large, expensive, heavy batteries. In use, this can make these vacuum cleaners unwieldy to carry, in both size and weight. Moreover, it can take a long time to fully recharge high capacity batteries, and batteries often degrade and require replacement during the working life of a vacuum cleaner. The battery replacement cost is a significant expense for the user.

In some embodiments disclosed herein, a surface cleaning apparatus includes a portable surface cleaning unit equipped with an energy storage member having one or more capacitors. As compared with rechargeable batteries (e.g. lead-acid, Ni-Cad, NiMH, or lithium), a capacitor can be recharged much faster, and have a much longer lifespan (measured in charge cycles). With battery powered vacuums, traditional design philosophy is that it is important to have a long runtime to mitigate having to recharge in the middle of a cleaning session, since the recharge could take several hours (e.g., 4-8), which would be disruptive to the user who wishes to finish their cleaning session in a timely manner. In contrast, with a capacitor powered portable cleaning unit, the need to recharge mid-session may be minimally disruptive as it may only require a few seconds to a few minutes to recharge. Therefore, a capacitor powered portable surface cleaning unit may include comparatively less energy storage capacity because avoiding a recharge mid-session is not a priority. As a result, a capacitor powered portable surface cleaning unit may have a relatively smaller and lighter on board energy storage member (one or more capacitors), as compared with a high capacity battery pack. This can make a capacitor powered portable surface cleaning unit smaller and lighter overall, without compromising performance or user experience. Moreover, the long lifespan of capacitors (often 1 million charge cycles or more) means that the capacitors will not generally require replacement during the working life of the portable surface cleaning unit.

The features in this section may be used by itself in any surface cleaning apparatus or in any combination or sub-combination with any other feature or features described herein.

For convenience, reference to "a capacitor" herein means "one or more capacitors", unless expressly stated otherwise (e.g. "a single capacitor"). Similarly, reference to "a battery" herein means "one or more batteries", unless expressly stated otherwise (e.g. "a single battery").

Referring to FIG. 4, portable surface cleaning unit 108 is shown including an energy storage member 272. Energy storage member 272 may include a capacitor 276. For example, capacitor 276 may be the only significant energy storage in energy storage member 272, or energy storage member 272 may further include a battery. Some or all of the power consuming elements of portable surface cleaning unit 108 may be powered by capacitor 276. For example, at least suction motor 212 may be powered by capacitor 276. In some embodiments, some or all power consuming elements of portable surface cleaning unit 108 may be exclusively powered by capacitor 276. For example, at least suction motor 212 may be exclusively powered by capacitor 276 in some embodiments.

Capacitor 276 may be any capacitor suitable for supplying power required to operate at least suction motor 212. For example, capacitor 276 may be an ultracapacitor (also referred to as a supercapacitor or Goldcap). As compared to an electrolytic capacitor, ultracapacitors have dramatically higher energy density (per unit mass and per unit volume). Types of ultracapacitors include electrostatic double-layer capacitors (EDLCs), electrochemical pseudocapacitors, and hybrid capacitors that store charge both electrostatically and electrochemically. Accordingly, it will be appreciated that a portable surface cleaning unit 108 may use only a single capacitor 276 or optionally, for example, 2, 3 or 4 capacitors 276.

Figure 7:
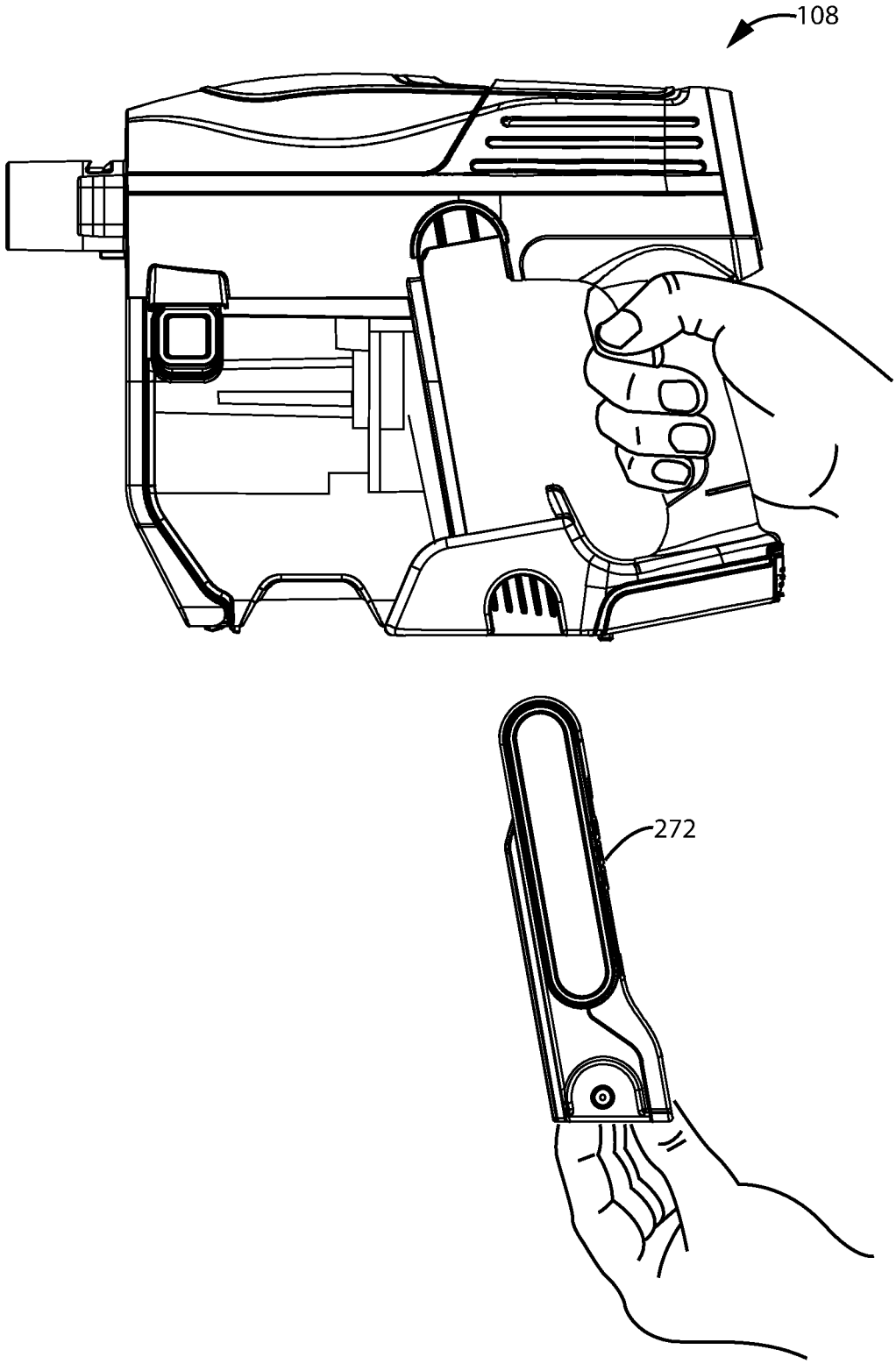
FIG. 7 is a side elevation view of the portable surface cleaning unit of FIG. 3 with an energy storage member removed.
Figure 8:
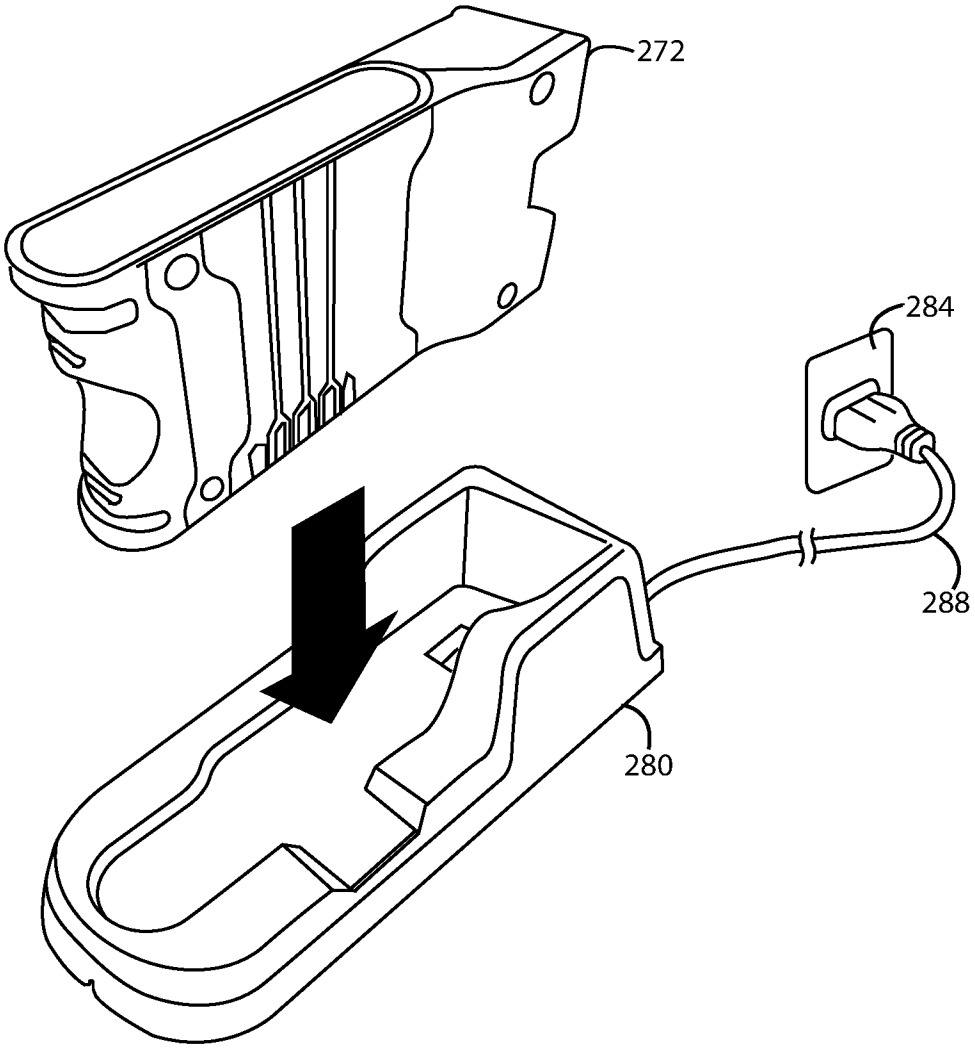
FIG. 8 is a perspective view of the energy storage member of FIG. 7 and a charger.

Capacitor 276 may be recharged by power from a power source external to portable surface cleaning unit 108. FIGS. 7-8 show an example in which energy storage member 272 is removable from portable surface cleaning unit 108 for electrically connecting to an external charger 280. External charger 280 may be powered by an electrical connection to a stationary power supply 284 (e.g. mains power). An advantage of this design is that the external charger 280 also reduces the size and weight of portable surface cleaning unit 108 as compared with including charger 280 within portable surface cleaning unit 108. Further, this design may not require portable surface cleaning unit 108 to have a power cord or power cord connector, which may also reduce the size and weight of portable surface cleaning unit 108 all else being equal. It will be appreciated that, if the capacitor is charged rapidly (e.g., 1, 2, 3, 4, or 5 minutes), then the user may be able to make a cup of coffee or make a quick call and then return to continue the cleaning operation with a fuller recharged capacitor 276.

A further advantage of this design is that it can allow the user to swap a discharged energy storage member 272 for a charged energy storage member 272 that has been stored on the charger 280.

Figure 9:
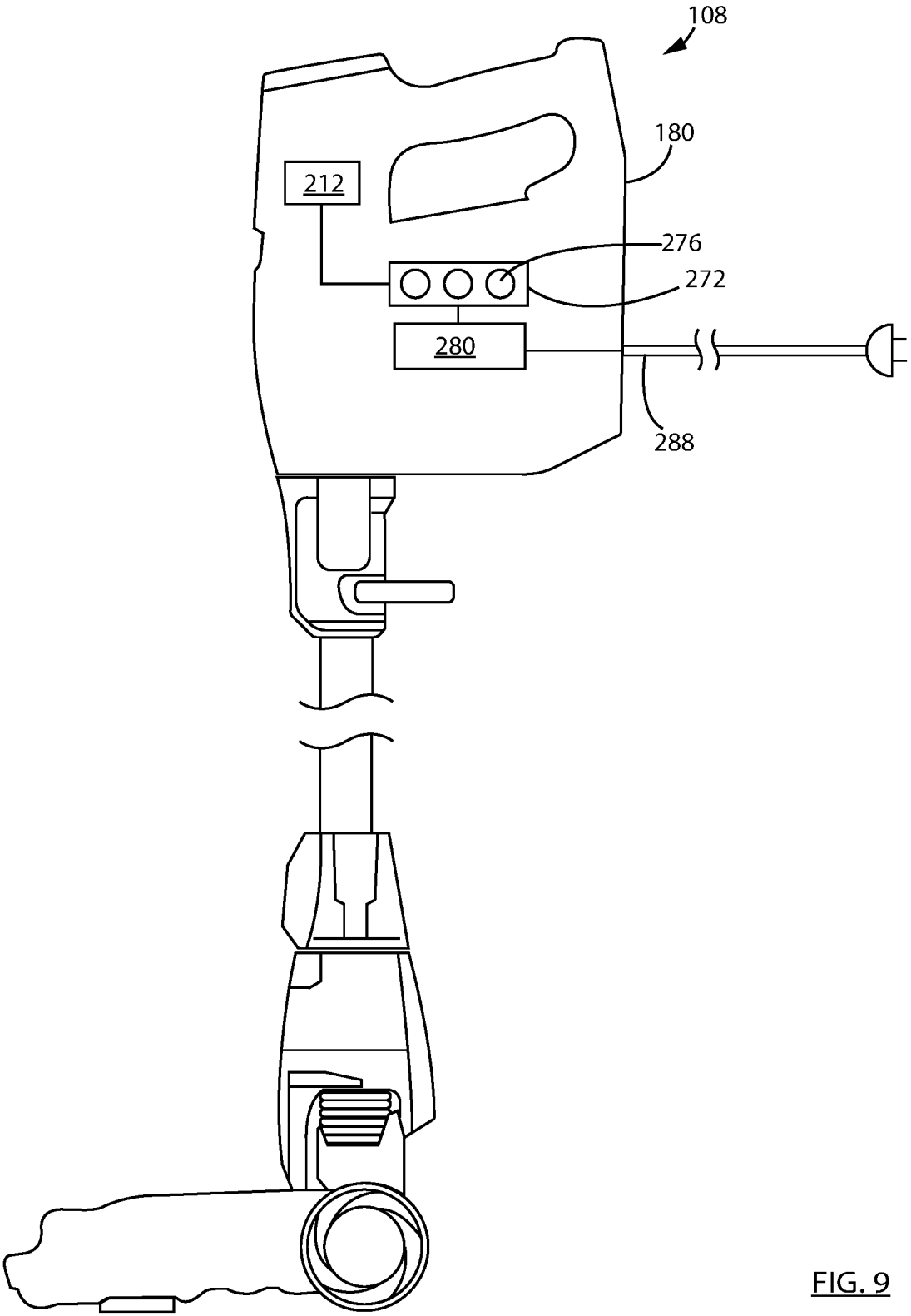
FIG. 9 is a schematic illustration of a surface cleaning apparatus in accordance with an embodiment.
Figure 10:
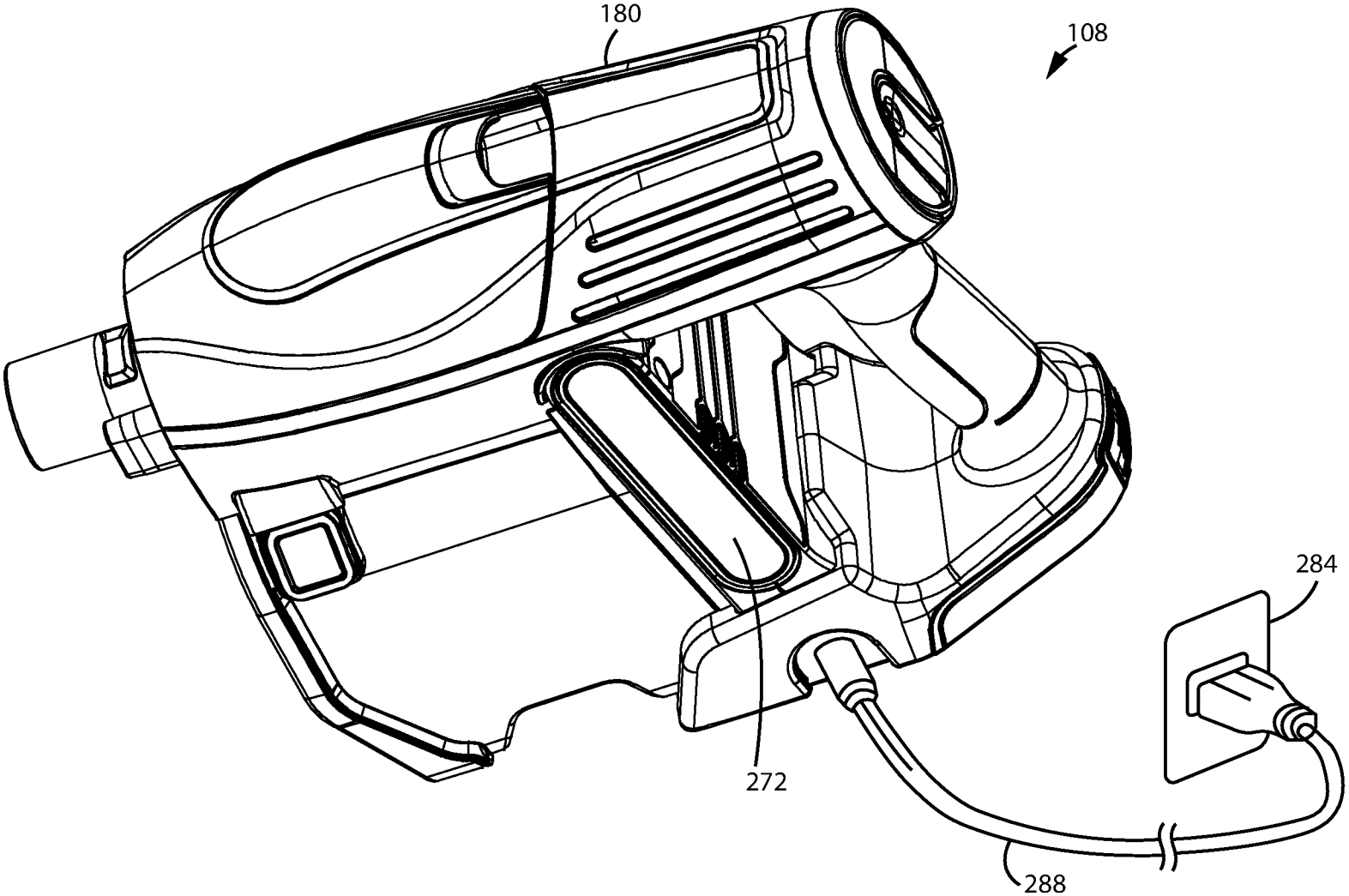
FIG. 10 is a perspective view of a portable surface cleaning unit connected by a power cable to a stationary power supply, in accordance with an embodiment.

Alternatively or in addition to energy storage member 272 being removable for recharging, energy storage member 272 may be rechargeable in-situ without removal from portable surface cleaning unit 108. For example, FIGS. 9-10 show an embodiment in which portable surface cleaning unit 108 includes a power cable 288 for transmitting power from stationary power supply 284 towards energy storage member 272. An advantage of a non-removable energy storage member 272 is that it may not require a discrete outer shell for user handling and transportation since it is permanently held within main body 180. Further, a non-removable energy storage member 272 may not require hardware to support easy user removal and insertion of energy storage member 272. This may make energy storage member 272 smaller and lighter, all else being equal.

In accordance with the alternate exemplified embodiment of FIGS. 9-10, portable surface cleaning unit 108 includes charger 280 within main body 180. An advantage of this design is that it may make connecting portable surface cleaning unit 108 to a stationary power supply 284 more convenient, in that an external charger does not need to be relocated to the selected stationary power supply 284.

Figure 11:
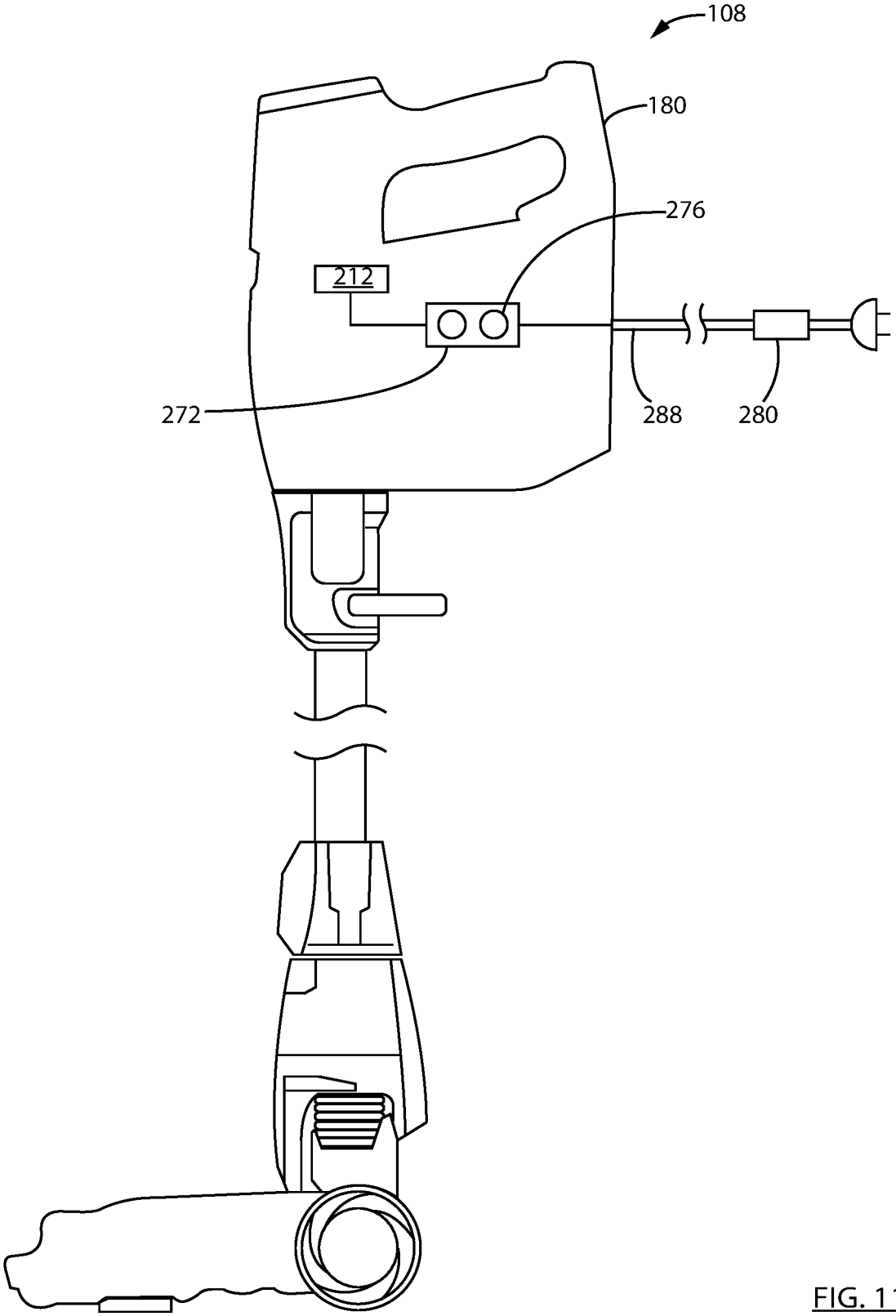
FIG. 11 is a schematic illustration of a surface cleaning apparatus in accordance with an embodiment.

FIG. 11 shows an alternative embodiment in which energy storage member 272 is rechargeable in-situ without removal from portable surface cleaning unit 108, by a corded connection to an external charger 280. An advantage of this design is that it may reduce the size and weight of portable surface cleaning unit 108 as compared with including charger 280 within portable surface cleaning unit 108, all else being equal.

In an alternate embodiment in which energy storage member 272 is rechargeable in-situ without removal from portable surface cleaning unit 108, the portable surface cleaning unit 108 may itself be plugged into the charger 280.

Energy storage member 272 may have sufficient energy capacity to power at least suction motor 212 (or all power consuming parts of portable surface cleaning unit 108) for at least 3 minutes (e.g. 3 minutes to 15 minutes). For example, an energy storage member 272 with a capacity of at least 5 Wh can provide 100 W of power to a suction motor 212 for at least 3 minutes. As mentioned above, all of the energy storage may be provided by capacitor 276 in some embodiments. A 3 to 5 minute runtime may be sufficient for short cleaning sessions, such as to clean crumbs off a couch, to clean dirt around a planter, or to clean cereal spilled by a child for example.

If a task is larger, and requires more runtime than energy storage member 272 can provide, then energy storage member 272 can be quickly recharged. For example, charger 280 (whether external or internal to portable surface cleaning unit 108) may be configured to recharge capacitor 276 at a rate of at least 2 C, 3 C or 4 C (e.g. at least 6 C, such as 4 C to 10 C, or 6 C to 10 C). This can allow capacitor 276 to be fully recharged in a matter of seconds or minutes, as compared with hours in the case of many batteries.

Figure 12:
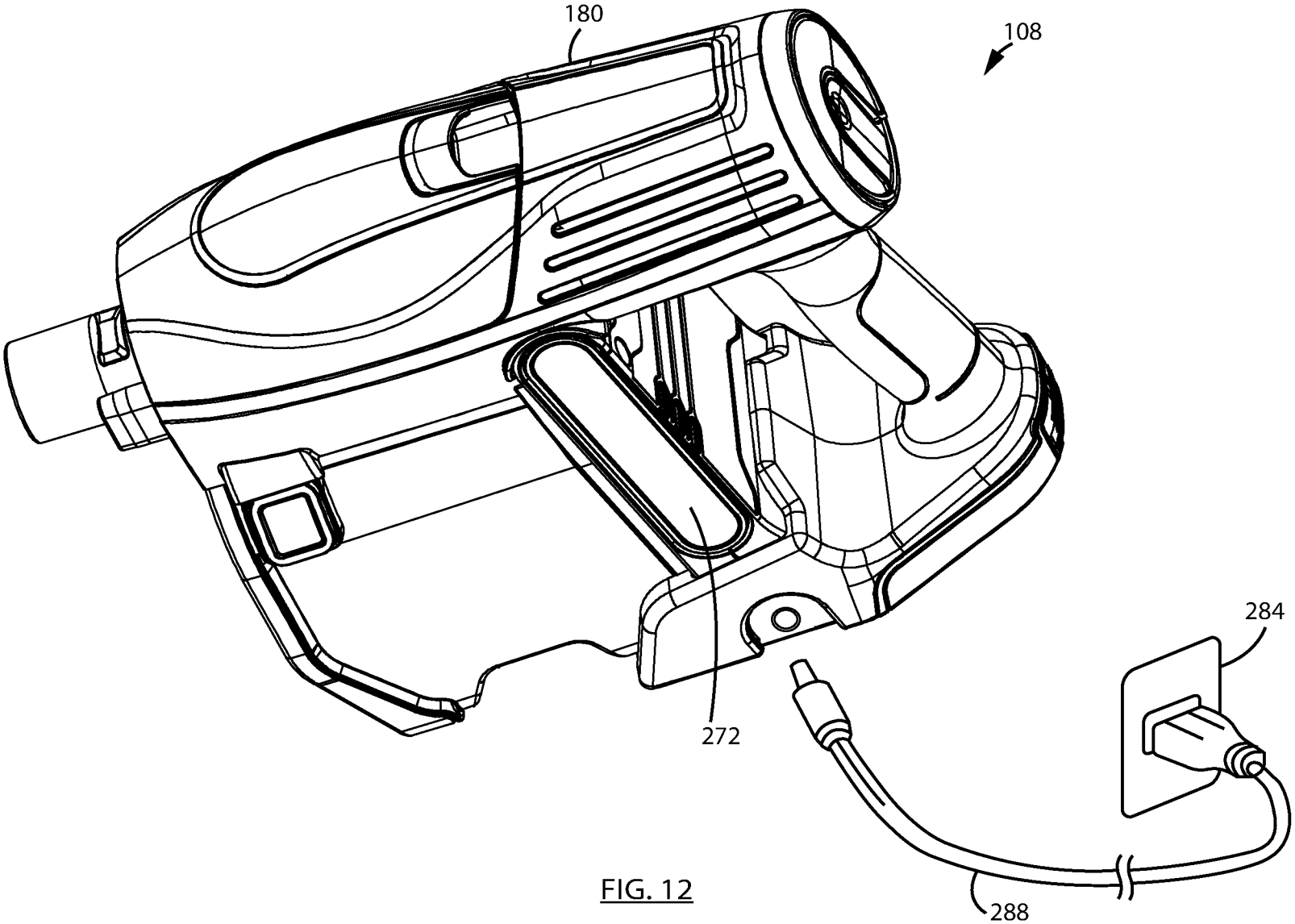
FIG. 12 is a perspective view of a portable surface cleaning unit disconnected from a power cable, in accordance with an embodiment.

Returning to FIG. 10, in some embodiments power cable 288 may be permanently connected to portable surface cleaning unit 108. An advantage of this design is that it may not require portable surface cleaning unit 108 to have hardware to support a removable connection, and it may make connecting portable surface cleaning unit 108 to a stationary power supply 284 more convenient to the extent that a separate power cable 288 does not need to be relocated to the selected power supply 284. FIG. 12 shows an alternative embodiment in which power cable 288 is removably connected to portable surface cleaning unit 108. For example, power cable 288 may be connected to portable surface cleaning unit 108 only to recharge energy storage member 272. An advantage of this design is that it does not require the user to carry the weight of power cable 288 when portable surface cleaning unit 108 does not require a connection to a stationary power supply 284 (e.g. when not recharging).

Capacitor Rechargeable In Upright Configuration

In some embodiments, the floor cleaning unit charges the capacitor of the portable surface cleaning unit when the portable surface cleaning unit is connected to the floor cleaning unit. For example, the capacitor of the portable surface cleaning unit may be recharged while the surface cleaning apparatus is operated in the upright configuration. Several advantages flow from this design. First, this design can mitigate the capacitor of the portable surface cleaning unit being dead when disconnected from the floor cleaning unit for use in the portable cleaning configuration. Second, this design can allow cleaning to continue in the upright configuration if the portable surface cleaning unit runs out of power in the portable surface cleaning mode. For example, if the capacitor of the portable surface cleaning unit runs out of power while cleaning an above-floor surface, the user may connect the portable surface cleaning unit to the floor cleaning unit and resume cleaning floor surfaces while the capacitor recharges. Third, this design can allow the capacitor to recharge while the portable surface cleaning unit is connected to the floor cleaning unit in the storage mode. This mitigates misplacing the floor cleaning unit, as compared to a design that requires the portable surface cleaning unit to be disconnected from the floor cleaning unit to recharge.

The features in this section may be used by itself in any surface cleaning apparatus or in any combination or subcombination with any other feature or features described herein.

Figure 13:
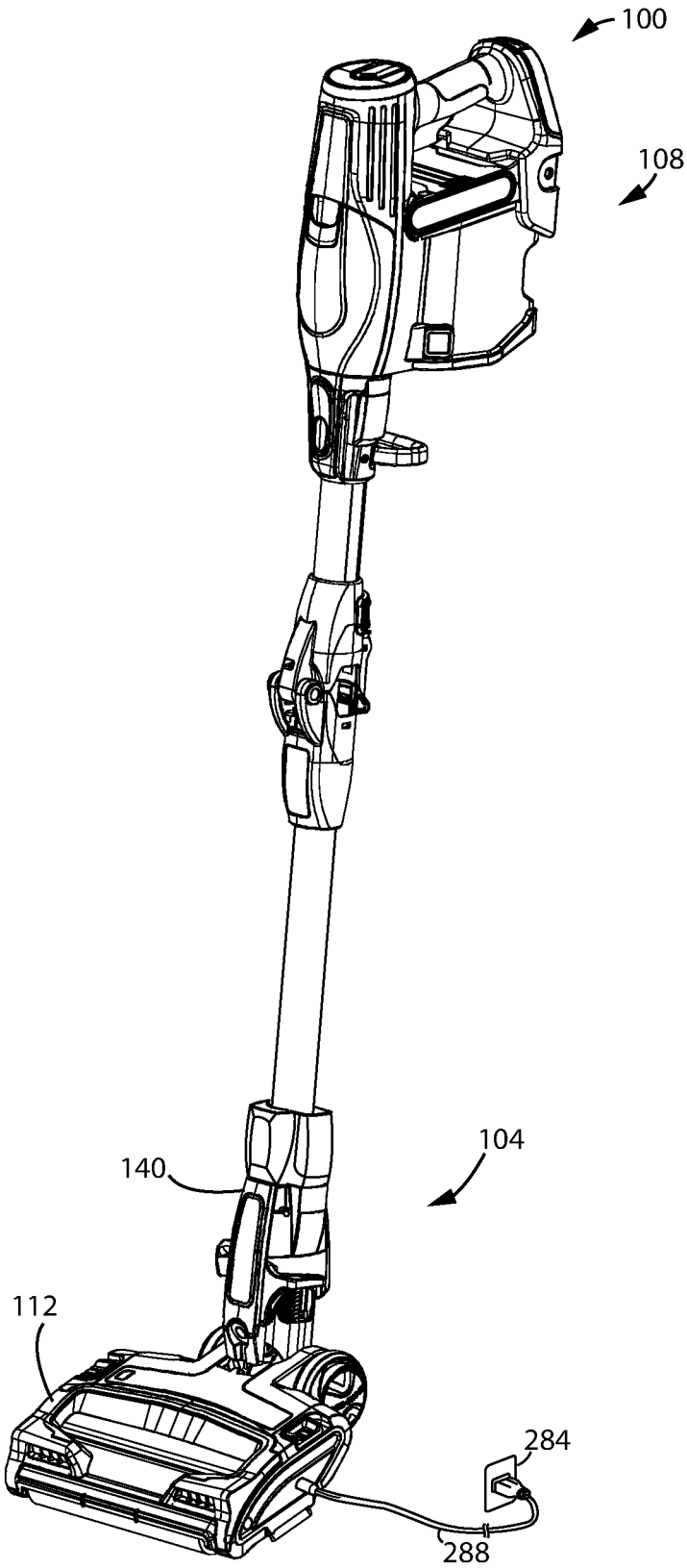
FIG. 13 is a perspective view of a surface cleaning apparatus with a floor cleaning unit connected by a power cable to a stationary power supply, in accordance with an embodiment.
Figure 14:
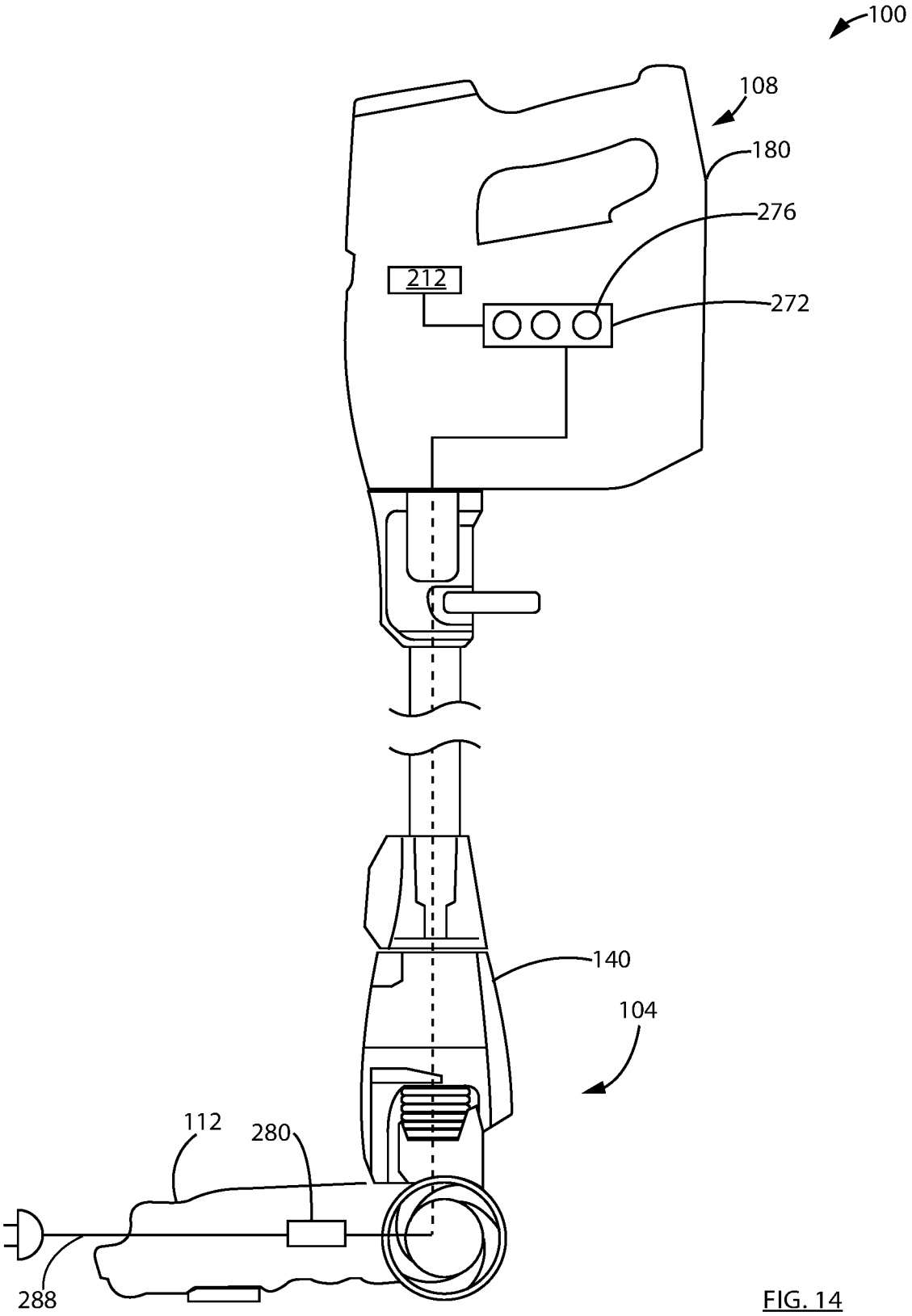
FIG. 14 is a schematic illustration of a surface cleaning apparatus in accordance with an embodiment.

Reference is now made to FIGS. 13-14. As shown, floor cleaning unit 104 may include a charger 280. For example, charger 280 may be located in surface cleaning head 112 as shown, or in upper section 140. When charger 280 is connected to a source of power, and portable surface cleaning unit 108 is connected to floor cleaning unit 104, charger 280 may recharge energy storage member 272 (including at least capacitor 276). In the illustrated example, portable surface cleaning unit 108 is connected to floor cleaning unit 104 in an upright configuration. Thus, energy storage member 272 may be recharged while surface cleaning apparatus 100 is in a storage position and/or an inclined floor cleaning position.

Embodiments that can recharge energy storage member 272 while apparatus 100 is in the inclined floor cleaning position can allow the user to continue cleaning without interruption when portable surface cleaning unit 108 runs out of power in a portable cleaning configuration. The rapid charging rate of capacitor 276 means that capacitor 276 may be fully recharged in a short period of time, and therefore allow the user to return to the portable cleaning configuration after only a short time in the upright configuration.

In some embodiments, suction motor 212 may be powered only (i.e. exclusively) by (i) energy storage member 272 (e.g. when in the portable cleaning configuration), or (ii) by a stationary power supply (e.g. mains power, when in the upright cleaning configuration). As shown, when in the upright cleaning configuration, charger 280 may be electrically connected by power cable 288 to stationary power supply 284. Power cable 288 may have a length suitable to allow surface cleaning apparatus 100 to be used for cleaning floors in the upright configuration while connected to stationary power supply 284. For example, power cable 288 may be at least 10-15 feet long.

Power cable 288 may be permanently connected to floor cleaning unit 104. For example, surface cleaning apparatus 100 may require an electrical connection to a stationary power supply 284 when in the upright configuration. This may encourage users to arrange their cleaning routine to allow energy storage member 272 to recharge between short periods of use in the portable cleaning configuration.

Alternatively, power cable 288 may be removably connected to floor cleaning unit 104. This allows surface cleaning apparatus 100 to operate in a cordless manner while in the upright configuration, even if only for a short duration subject to the power capacity of energy storage member 272. For example, this can allow surface cleaning apparatus 100 to be used in an upright configuration to clean floors (e.g. in an unfinished basement) where there is not an electrical outlet within range.

Figure 15:
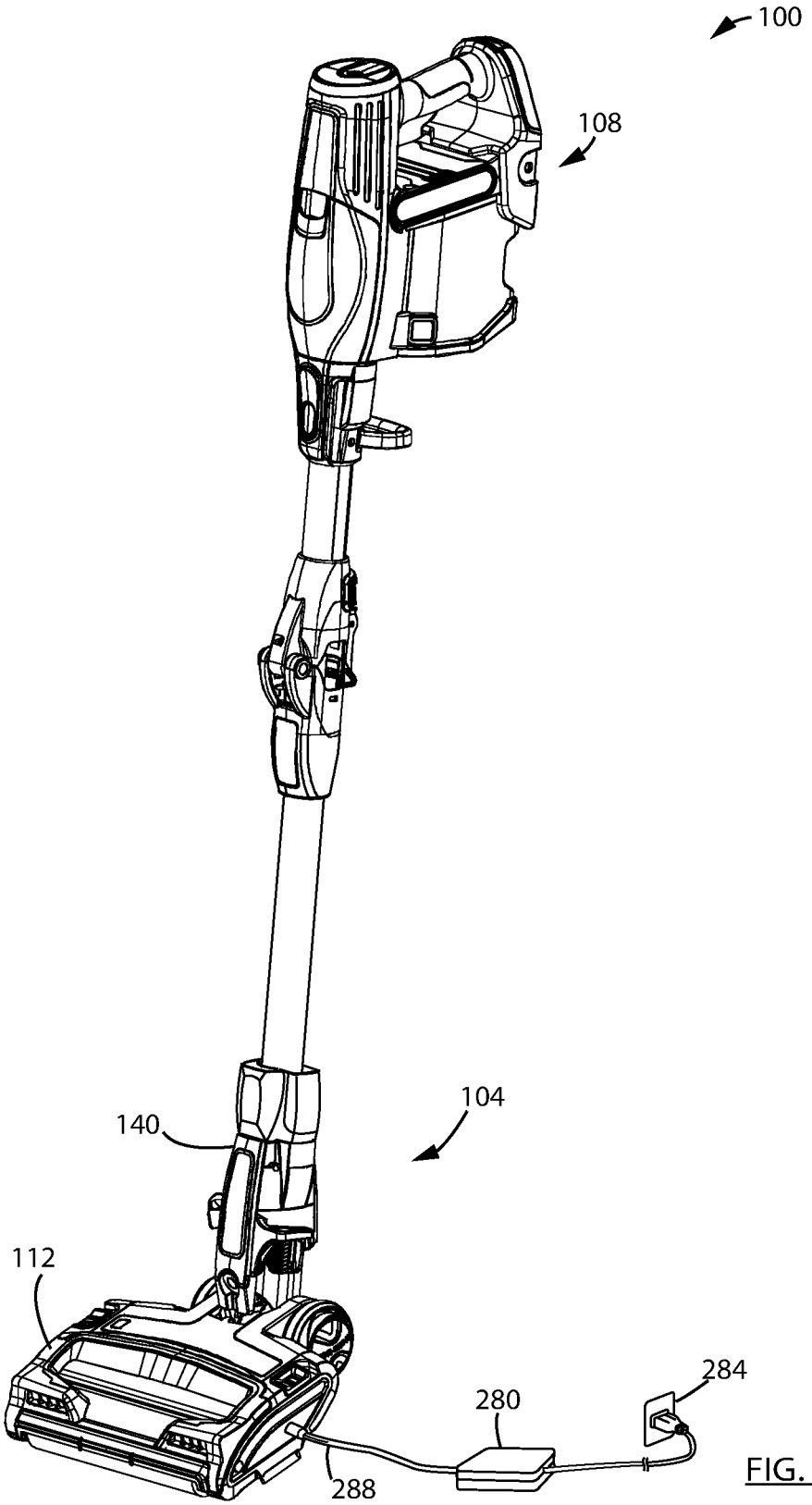
FIG. 15 is a perspective view of a surface cleaning apparatus with a floor cleaning unit connected by a power cable to a charger, in accordance with an embodiment.

FIG. 15 shows an embodiment in which charger 280 is located external to floor cleaning unit 104. This can reduce the size and weight of floor cleaning unit 104 as compared with a design having charger 280 inside floor cleaning unit 104.

Floor Cleaning Unit Including An Energy Storage Member

In some embodiments, the floor cleaning unit may include an energy storage member. The energy storage member may have sufficient power capacity to fully recharge the capacitor of the portable surface cleaning unit several times. This allows a continuous cordless cleaning session with the surface cleaning apparatus wherein the cleaning session includes two or more iterations of (i) cleaning with the portable cleaning unit in the portable cleaning configuration, and (ii) recharging the portable cleaning unit while cleaning in the upright cleaning configuration. The floor cleaning unit may include a relatively inexpensive, rechargeable energy storage member (e.g. a lead acid, NiCad, NiMH, or lithium) with an energy storage capacity that is several times greater than the capacitor of the portable surface cleaning unit. While providing a rechargeable energy storage member in the floor cleaning unit (optionally the surface cleaning head) increases the weight of the floor cleaning unit, this added weight is supported by the floor being cleaned, and may also help stabilize the surface cleaning apparatus 100 when in the storage configuration by lowering the center of gravity. Alternately, or in addition, it can provide needed weight to help maintain the dirty air inlet of the surface cleaning head a desired distance from the floor being cleaned.

The features in this section may be used by itself in any surface cleaning apparatus or in any combination or subcombination with any other feature or features described herein.

Figure 16:
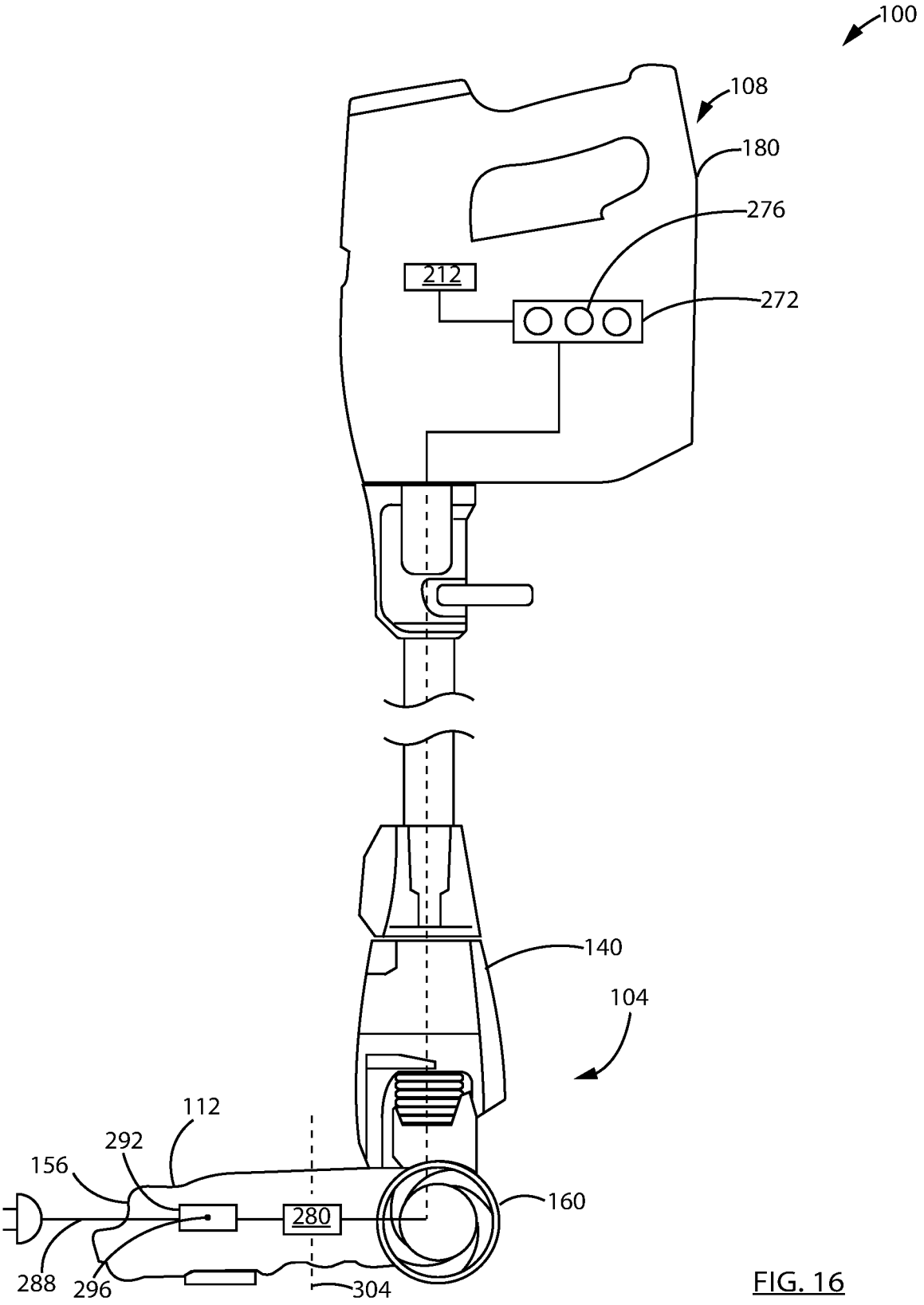
FIG. 16 is a schematic illustration of a surface cleaning apparatus in accordance with an embodiment.

Referring to FIG. 16, floor cleaning unit 104 may include an energy storage member 292. Floor cleaning unit 104 may also include a charger 280 as shown. Charger 280 may include one or more charging circuits for one or more of:

(i) supplying power from a stationary power supply (i.e. via power cable 288) to energy storage member 292;

(ii) supplying power from the floor cleaning unit energy storage member 292 to the portable surface cleaning unit energy storage member 272; and, (iii) supplying power from a stationary power supply (i.e. via power cable 288) to energy storage member 272.

Energy storage member 292 can be any device suitable to supply power for fully recharging energy storage member 272 one or several times. For example, energy storage member 292 may include a battery and/or a capacitor that collectively have an energy storage capacity sufficient to recharge energy storage member 272 (or at least capacitor 276) two or more times (e.g. three or more times, or six or more times).

In some embodiments, when portable surface cleaning unit 108 is connected to floor cleaning unit 104, and floor cleaning unit 104 is disconnected from an external power supply (e.g. power cable 288 is disconnected from mains power, and/or disconnected from floor cleaning unit 104), energy storage member 272 is charged by charger 280 with power from energy storage member 292. In this situation, surface cleaning apparatus 100 may be operated in the inclined floor cleaning position to clean floors while energy storage member 272 is charging. After a short period (e.g. 15 minutes or less), energy storage member 272 will have been substantially or fully recharged, and portable surface cleaning unit 108 can be removed for use again in the portable cleaning configuration.

While energy storage member 272 is being charged by charger 280 from power supplied by energy storage member 292, suction motor 212 may be powered exclusively by energy storage member 272. An advantage of this design is that it does not require portable surface cleaning unit 108 to include circuitry that can electrically reconfigure suction motor 212 to receive power directly from energy storage member 292 and/or enable suction motor 212 to receive power directly from energy storage member 292. Further, this design does not require energy storage member 292 to be capable of discharging at a rate sufficient to supply both (i) recharging of energy storage member 272, and (ii) powering suction motor 212.

Alternatively, while energy storage member 272 is being charged by charger 280 from power supplied by energy storage member 292, suction motor 212 may be powered exclusively by energy storage member 292. An advantage of this design is that it may reduce or stop the discharge of energy storage member 272, so that energy storage member 272 can sooner attain a substantially or full charge for use in the portable cleaning configuration.

Alternatively, while energy storage member 272 is being charged by charger 280 from power supplied by energy storage member 292, suction motor 212 may be powered by energy storage members 272, 292 together.

In some embodiments, when portable surface cleaning unit 108 is connected to floor cleaning unit 104, and floor cleaning unit 104 is connected to an external power supply (e.g. power cable 288 is connected to mains power and floor cleaning unit 104) one or more of the following may occur concurrently:

(i) energy storage member 272 may be charged by charger 280 with power from energy storage member 292 and/or power from the external power supply;

(ii) energy storage member 292 may be charged by charger 280 with power from the external power supply; and, (iii) suction motor 212 may be powered by energy from energy storage member 272, and/or energy storage member 292, and/or the external power supply.

An advantage of partially or completely powering suction motor 212 from the external power supply in this situation is that it can reduce or stop the discharge of energy due to energy storage members 272, 292 powering the suction motor 212 so that energy storage members 272, 292 can sooner attain be substantially or fully recharged. Once energy storage members 272, 292 have attained a substantial or full charge, surface cleaning apparatus 100 can again be used in a cordless configuration (e.g. power cable 288 can be disconnected from mains power and/or disconnected from floor cleaning unit 104).

Figure 17:
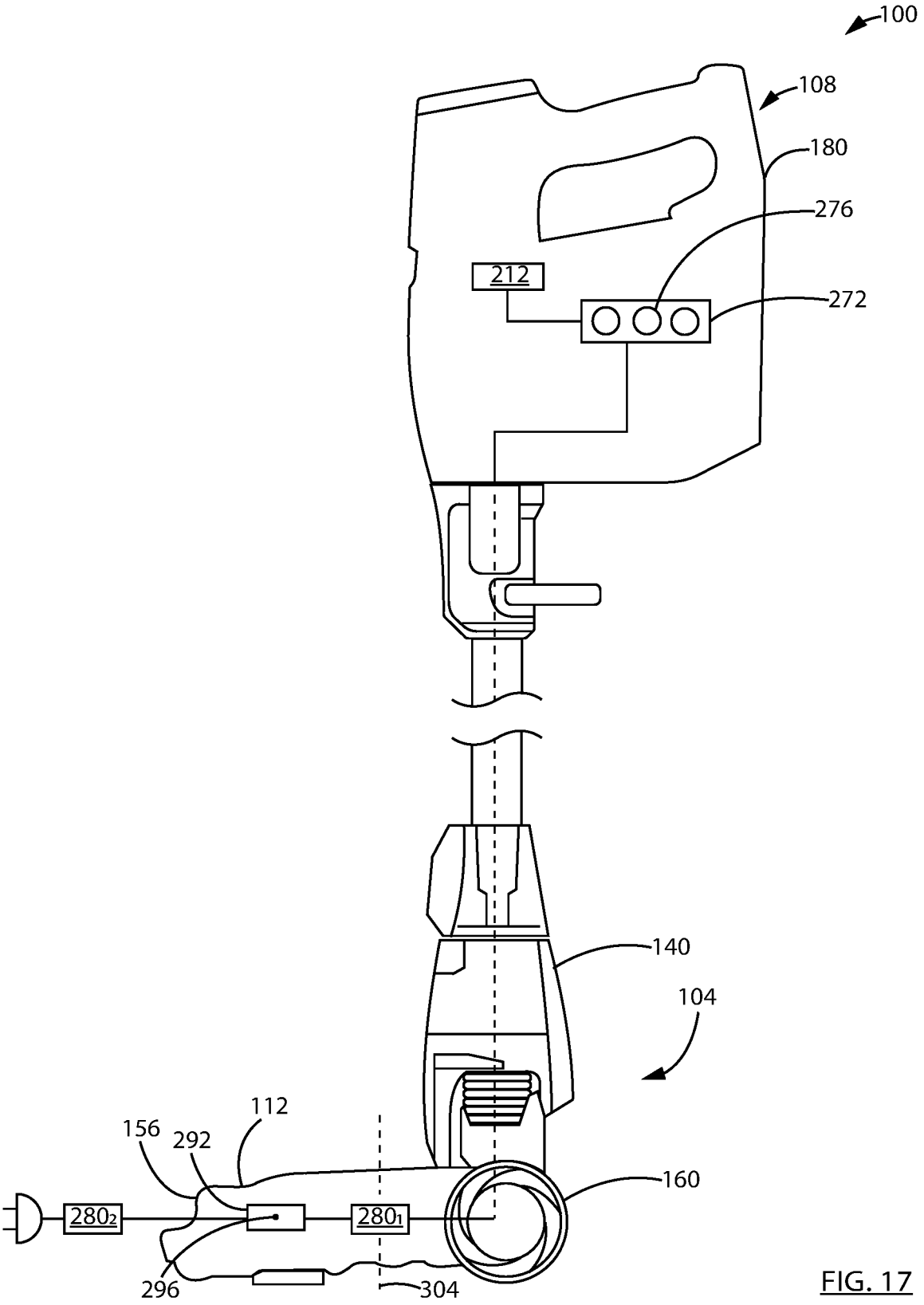
FIG. 17 is a schematic illustration of a surface cleaning apparatus in accordance with an embodiment.

Reference is now made to FIG. 17. Alternatively or in addition to providing a charger 2801 in floor cleaning unit 104, floor cleaning unit 104 may be connectable to an external charger 2802. For example, internal charger 2801 may be configured with a charging circuit for transferring power from energy storage member 292 to energy storage member 272, and external charger 2802 may be configured with a charging circuit for transferring power from an external power supply (e.g. mains power) to energy storage member 292. This design may reduce the size and/or weight of floor cleaning unit 104 as compared with a design that includes both chargers 2801 and 2802 (or a single charger with the functionality of both chargers) inside floor cleaning unit 104.

Referring to FIGS. 16-17, energy storage member 292 may be located anywhere inside floor cleaning unit 104. For example, energy storage member 292 may be located at (e.g. inside, part of, or attached to) surface cleaning head 112 as shown, or upper section 140. In the illustrated embodiment, surface cleaning head 112 has a center 304 located midway between front and rear ends 156, 160, and energy storage member 292 has a center of gravity 296 located forward of cleaning head center 304. An advantage of this design is that energy storage member 292 may help move the center of gravity of surface cleaning apparatus 100 forwards, and thereby help stabilize surface cleaning apparatus 100 when in the storage position. For example, a more forward center of gravity of apparatus 100 may mitigate surface cleaning apparatus tipping over rearwardly when in the storage position.

Thermal Cooling During Charging and/or Discharging

The rate at which an energy storage member can be charged, without suffering damage or substantial degradation, may be limited by heat generated during charging. When an energy storage member for an appliance is charged, the generated heat can raise the temperature of the energy storage member to dangerous or damaging levels. In some embodiments, a thermal cooling unit that, directly or indirectly, cools an appliance energy storage member during charging is provided. This can help keep the temperature of the energy storage member within safe limits when the energy storage member is charged rapidly (e.g. at a rate of 4 C or faster). If the charger is in a surface cleaning unit, then the surface cleaning apparatus may include the charger and the thermal cooling unit. Alternately, if the charger is remote, then the charger may include the thermal cooling unit. Such a thermal cooling unit may be referred to as an appliance energy storage member thermal cooling unit.

As discussed herein, a charger which is used to charge an energy storage member may itself have an onboard energy storage member. The rate at which such an on board energy storage member can be discharged, without suffering damage or substantial degradation, may also be limited by heat generated during discharge. When an energy storage member is rapidly discharged, the generated heat can raise the temperature of the energy storage member to dangerous or damaging levels. In some embodiments, a thermal cooling unit that, directly or indirectly, cools an charger energy storage member during discharging is provided. This can help keep the temperature of the energy storage member of the charger within safe limits when the charger is rapidly charging an energy storage member (e.g. at a rate of 4 C or faster). If the charger is in a surface cleaning unit, then the surface cleaning apparatus may include the charger and the thermal cooling unit. Alternately, if the charger is remote, then the charger may include the thermal cooling unit. Such a thermal cooling unit may be referred to as an charger energy storage member thermal cooling unit.

It will be appreciated that, in some embodiments, the appliance energy storage member thermal cooling unit and the charger energy storage member thermal cooling unit may be the same thermal cooling unit.

The features in this section may be used by itself in any surface cleaning apparatus or in any combination or sub-combination with any other feature or features described herein.

Figure 18:
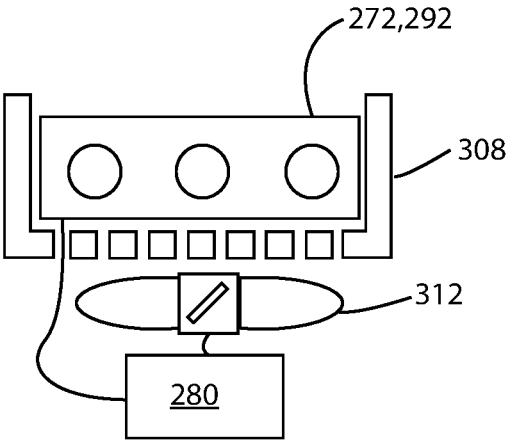
FIGS. 18-20 are schematic illustrations of an energy storage member, a thermal cooling unit, and a charger, in accordance with various embodiments.
Figure 19:
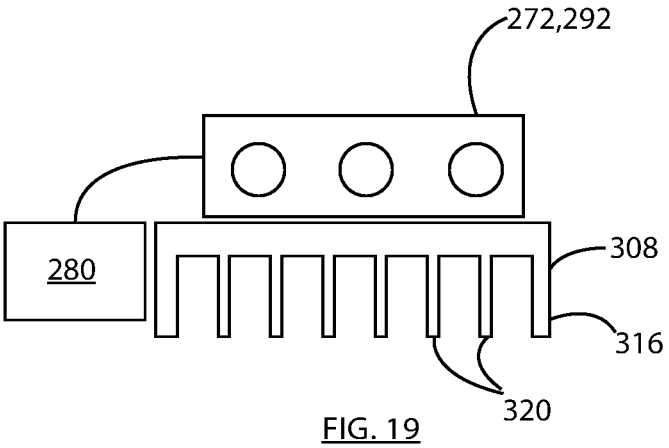
Figure 20:
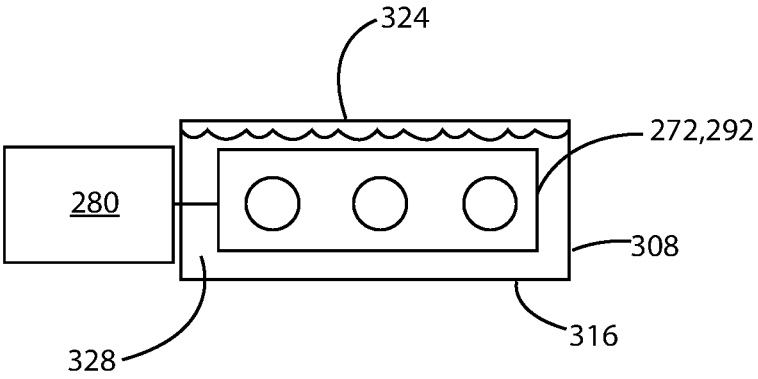

FIGS. 18-20 illustrate various embodiments of a charger 280 electrically connected to an energy storage member 272 or 292, and a thermal cooling unit 308 thermally connected to the energy storage member 272, 292 to remove heat generated during recharging of energy storage member 272 or 292 or the discharge of energy storage member 292, and thereby keep the temperature of the energy storage member 272, 292 within safe limits when the energy storage member is charged rapidly or the energy storage member 292 is discharged rapidly.

Figure 22:
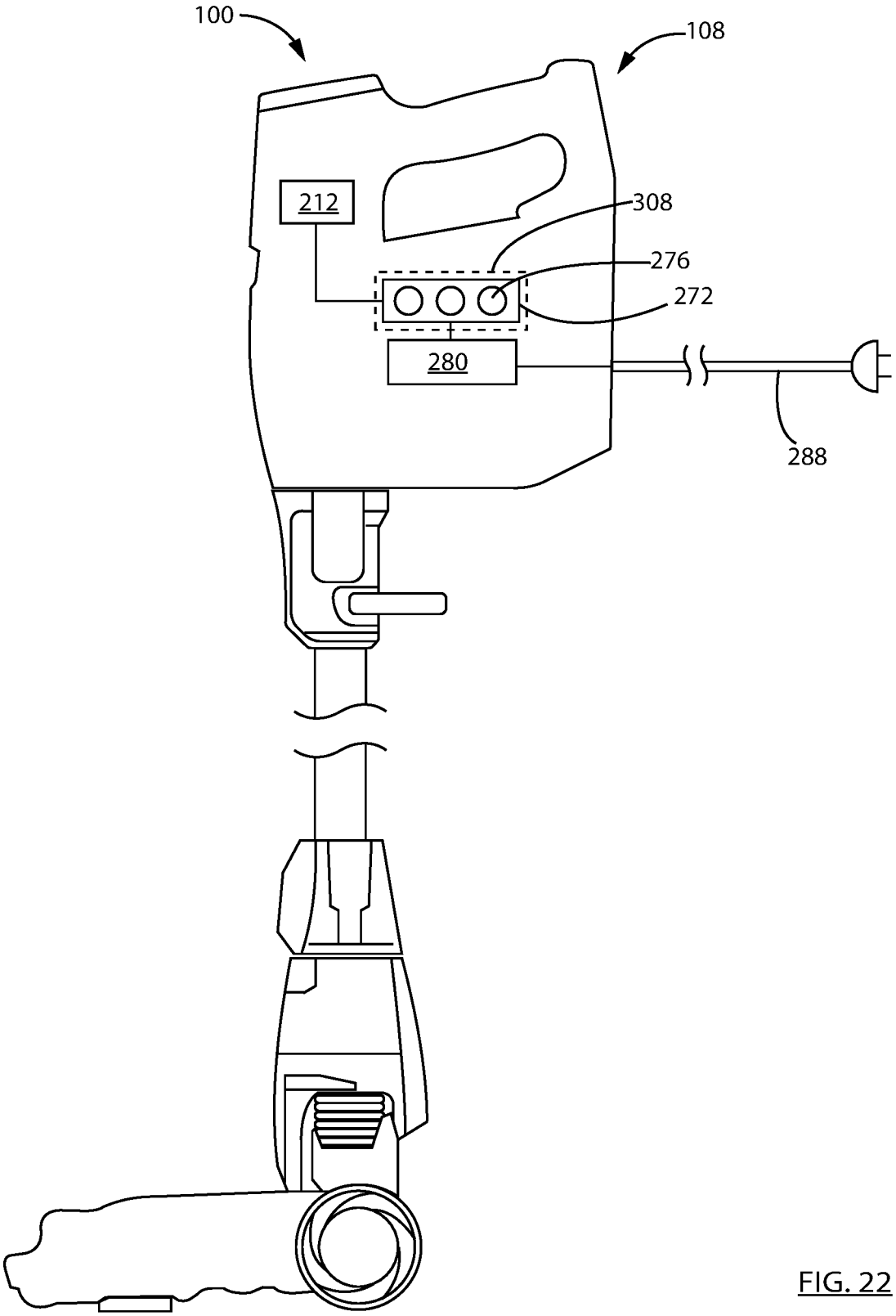
FIG. 22 is a schematic illustration of a surface cleaning apparatus in accordance with an embodiment.
Figure 23:
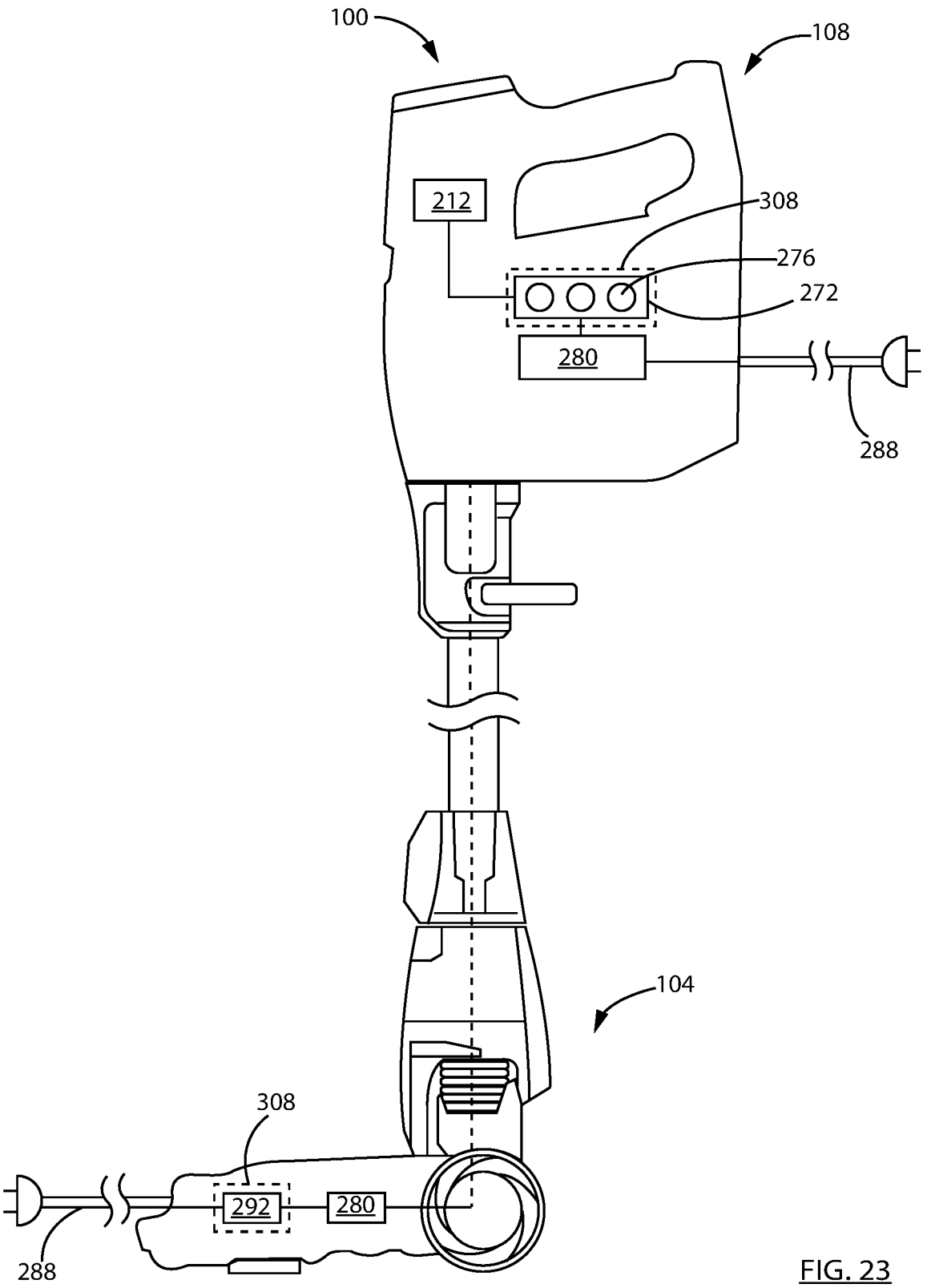
FIG. 23 is a schematic illustration of a surface cleaning apparatus in accordance with an embodiment; and, FIG. 24 is a schematic illustration of a surface cleaning apparatus in accordance with an embodiment.
Figure 24:
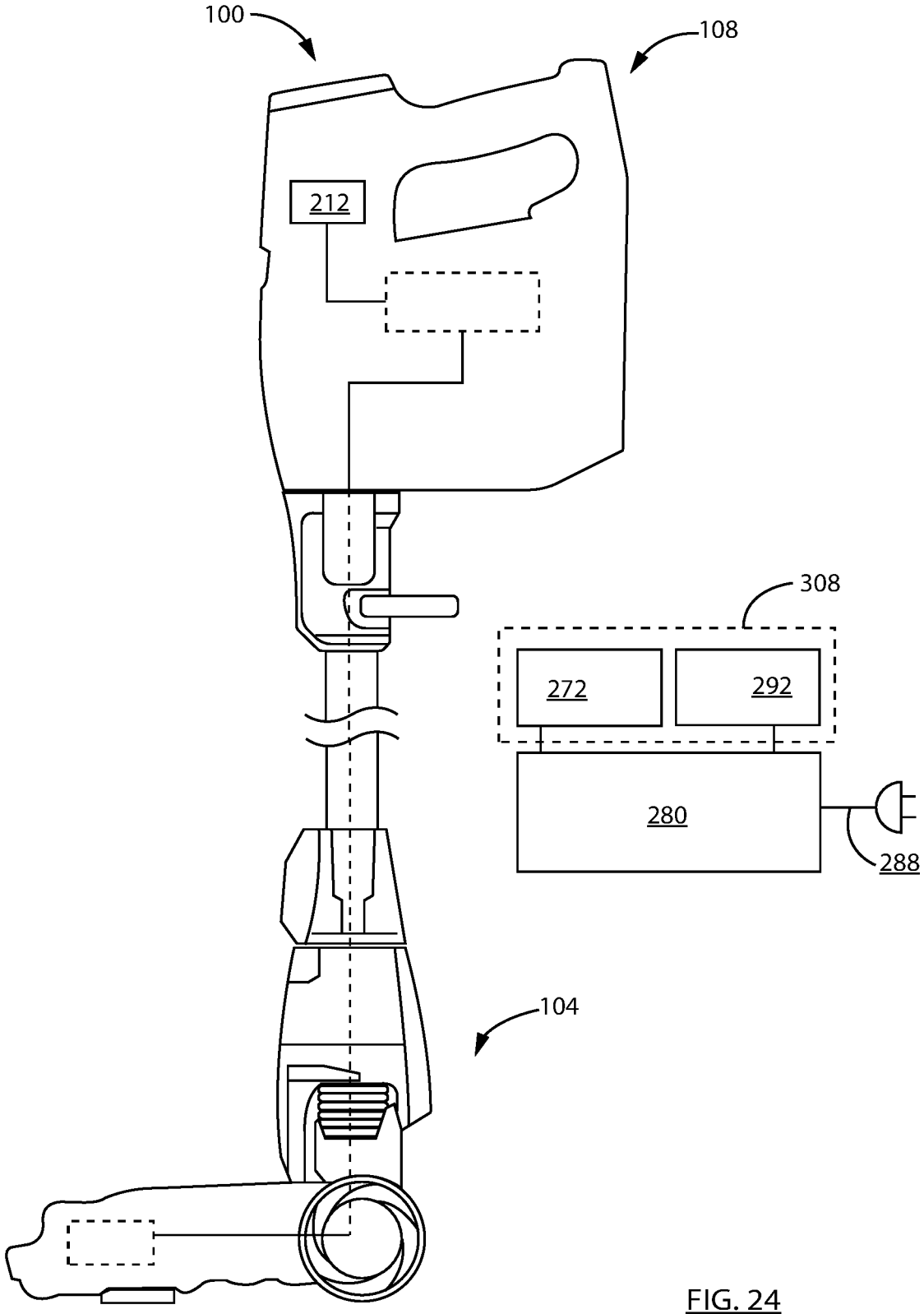

It will be appreciated that the arrangements described herein including a thermal cooling unit 308 can be used in combination with energy storage member 272 and/or 292 in any embodiment of surface cleaning apparatus 100, floor cleaning unit 104, or portable surface cleaning unit 108 described elsewhere or illustrated in any figure. Further, a thermal cooling unit 308 may be included at a location at which the energy storage member is used (e.g., in the portable surface cleaning unit 108) or where the energy storage member is recharged (e.g., in the portable surface cleaning unit 108 if recharged in situ or in charger 280 if recharged exterior to appliance 100). For example, referring to FIGS. 22 and 23, the portable surface cleaning unit 108 may include a thermal cooling unit 308 as energy storage member 272 may be recharged in situ. Alternately, or in addition, as exemplified in FIG. 23, surface cleaning head 112 may include a thermal cooling unit 308 to cool energy storage member 292 when energy storage member 292 is charged and/or discharged. In the alternate embodiment exemplified in FIG. 24., energy storage member 272 is recharged external to the apparatus 100. Accordingly, remote charger 280 is provided with a thermal cooling unit 308 that may be used to cool energy storage member 272 and/or 292 during charging and/or to cool energy storage member 292 during discharge. It will be appreciated that charger 280 may have a single thermal cooling unit 308 that is thermally connected to each of energy storage members 272, 292 when energy storage members 272, 292 are installed in the charger 280. Alternately, a first thermal cooling unit 308 may be provided that is thermally connected to energy storage members 272 when energy storage member 272 is installed in the charger 280 and a second thermal cooling unit 308 may be provided that is thermally connected to energy storage members 292 when energy storage member 292 is installed in the charger 280.

Referring to FIG. 18, in some embodiments, thermal cooling unit 308 may include active cooling. Any active cooling means known in the art may be used. That is, thermal cooling unit 308 may include a powered cooling element 312. An advantage of this design is that the rate of cooling can be controlled by regulating the power supplied to cooling element 312. This may provide better control over the temperature of energy storage member 272, 292. Powered cooling element 312 may be any powered device that can be operated to remove heat from energy storage member 272, 292. For example, powered cooling element 312 may be a fan as shown, a coolant circulating pump (e.g., the energy storage member or a casing in which the energy storage member is received) may include flow channels through which a cooling fluid may flow due to operation of the coolant circulating pump), or a Peltier cooler. As shown, charger 280 may be configured to control the operation of powered cooling element 312. For example, charger 280 may include a temperature sensor that provides a signal to a controller that, in turn, controls the speed of fan 312 according to a signal from the sensor that represents the temperature of energy storage member 272, 292.

Alternatively or in addition to a powered cooling element 312, thermal cooling unit 308 may include a passive cooling element 316. A passive cooling element 316 may be an unpowered device that is effective for removing heat from energy storage member 272, 292 during charging. FIG. 19 shows an example in which passive cooling element 316 is a heat sink (e.g. a metal heat sink, such as an aluminum heat sink). FIG. 20 shows an example in which passive cooling element 316 is a liquid heat sink.

In some embodiments, passive cooling element 316 may be configured to provide an enlarged surface area to promote natural convective cooling with the ambient air. For example, heat sink 316 in FIG. 19 includes a plurality of fins 320 that collectively provide a large surface area for convective cooling. In use, energy storage member 272, 292 is positioned in thermal (e.g., abutting) contact with heat sink 316 whereby heat from energy storage member 272, 292 is transferred into heat sink 316 by conduction, and heat from heat sink 316 is lost by convection into the ambient air.

Alternatively or in addition to promoting convective heat loss, passive cooling element 316 may have a heat capacity sufficient to absorb the heat generated by one or several charges of energy storage member 272, 292 (e.g. at least 2 charge cycles, at least 3 charge cycles, or at least 4 charge cycles) and/or the rapid discharge of energy storage member 292. For example, passive cooling element 316 may include a volume of material that after absorbing one or several charges of energy storage member 272, 292, maintains the energy storage member 272, 292 below a target temperature. In the exemplary embodiment of FIG. 19, heat sink 316 may be composed of a sufficient volume of metal (e.g. aluminum) to achieve this effect. In FIG. 20, thermal cooling unit 308 is shown including a housing 324 that holds energy storage member 272, 292 in a volume of liquid 328 (e.g. mineral oil, or other coolant). The liquid 328 may have sufficient volume to maintain the temperature of energy storage member 272, 292 within safe limits after several charging cycles.

After passive cooling element 316 has absorbed the heat generated by a number of charge cycles, and the user has finished their cleaning session, passive cooling element 316 will passively cool back to room temperature while surface cleaning apparatus 100 rests in storage (e.g. overnight). Once at room temperature, passive cooling element 316 will again be capable of absorbing heat generated by a number of charge cycles.

In an alternate embodiment, it will be appreciated that passive cooling element 319 may also be provided with active cooling using any technique disclosed herein.

Method of Cleaning with a Capacitor-Powered Portable Surface Cleaning Unit

A surface cleaning apparatus operable in both upright and portable cleaning configurations, and having a portable surface cleaning unit that may be powered by a rapidly rechargeable energy storage member (e.g. a capacitor-powered portable surface cleaning unit) may be operated according to a new paradigm. Whereas conventional philosophy has been that a handvac should have a maximized runtime so that all surfaces requiring use of the handvac can be cleaned at in one continuous operation without recharging the handvac, embodiments disclosed herein promote a cleaning session that includes several iterations of: (i) cleaning in an upright configuration while the portable surface cleaning unit charges, and (ii) cleaning in a portable cleaning configuration with the portable surface cleaning unit powered by its, e.g., capacitor. This method of alternating between upright and portable cleaning configurations, lowers the required energy storage capacity of the portable surface cleaning unit. This means the portable surface cleaning unit can have a smaller, lighter, and possibly less expensive energy storage member. In order to achieve several full charges of the portable surface cleaning unit within a single uninterrupted cleaning session, the energy storage member preferably uses a capacitor which enables very fast charging.

It will be appreciated that, in other embodiments, a battery or battery pack that is rapidly chargeable may also be used. For example, if the handvac may have a short run time (e.g., 3, 5, 7 or 10 minutes), then the handvac may have only one or a few (e.g., 2 or 3) batteries. In such a case, the amount of energy required to fully charge the batteries is reduced compared to traditional battery packs that may have 6-7 batteries. Accordingly less heat will be generated during rapid recharging and the handvac may accordingly include a thermal cooling unit 308 that does not add excessive weight to the handvac.

The features in this section may be used by itself in any surface cleaning apparatus or in any combination or sub-combination with any other feature or features described herein.

Figure 21:
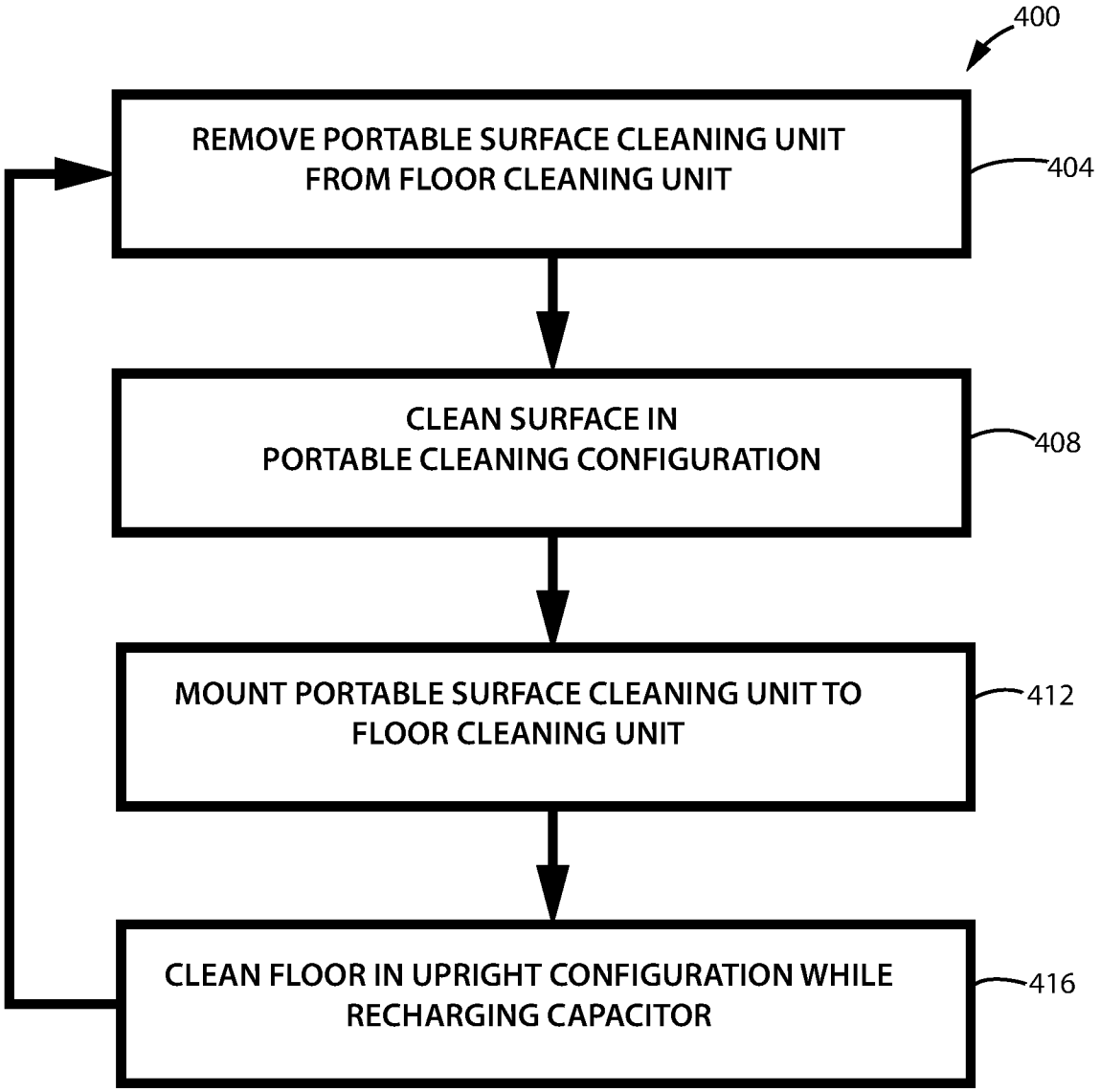
FIG. 21 is a flowchart illustrating a method of cleaning with a surface cleaning apparatus, in accordance with an embodiment.

Referring to FIGS. 2 and 21, a method 400 of cleaning a surface using surface cleaning apparatus 100 (e.g. a stick-vac) is shown.

At 404, portable surface cleaning unit 108 (e.g. handvac 108) is removed from floor cleaning unit 104. For example, portable cleaning unit 108 may be disconnected from rigid conduit upper end 264 to reconfigure surface cleaning apparatus 100 into a portable cleaning configuration.

At 408, portable surface cleaning unit 108 is used to clean surface(s) in the portable cleaning configuration. For example, portable surface cleaning unit 108 may be used to clean surfaces unsuitable for surface cleaning head 112, such as seat cushions, counters, drapes, and ceilings. Portable surface cleaning unit 108 may be powered by a capacitor 276 (FIG. 4).

At 412, portable surface cleaning unit 108 is remounted to floor cleaning unit 104. For example, portable cleaning unit 108 may be reconnected to rigid conduit upper end 264 to reconfigure surface cleaning apparatus 100 into an upright configuration.

At 416, surface cleaning apparatus 100 is used in the upright configuration to clean a floor, simultaneously while portable surface cleaning unit 108 recharges. Capacitor 276 (FIG. 4) may be recharged by an internal or external charger 280 with power from an external power supply and/or another energy storage member 292, as described above in connection with FIGS. 9-17. Cleaning and recharging in step 416 may continue for a period sufficient to substantially or fully recharge capacitor 276 (FIG. 4). For example, step 416 may continue for up to 15 minutes or for up to 10 minutes or for up to 5 minutes or for up to 3 minutes, during which capacitor 276 (FIG. 4) may be substantially recharged or fully recharged.

As shown, after step 416, method 400 may return to step 404 and continue until the cleaning session is completed. Accordingly, a user may remove the portable cleaning unit 108 and use it in the portable cleaning unit configuration until portable cleaning unit 108 requires recharging or until the cleaning job is finished.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising:

(a) a floor cleaning unit comprising:

(i) a surface cleaning head having a front end having a dirty air inlet, a rear end and a center positioned midway between the front end and the rear end;

(ii) an upper section moveably mounted to the surface cleaning head between an upright storage position and a rearwardly inclined floor cleaning position;

(iii) a charger having an energy storage member; and, (iv) an air flow path extending from the dirty air inlet to a floor cleaning unit air outlet; and, (b) a portable surface cleaning unit connectable to the floor cleaning unit, the portable surface cleaning unit comprising a portable surface cleaning unit air inlet connectable in air flow communication with the floor cleaning unit air outlet, a main body, an air treatment member, a suction motor, a handle and a capacitor, wherein, when fully charged, the energy storage member stores sufficient stored power to recharge the capacitor at least twice;

when the portable surface cleaning unit is connected to the floor cleaning unit, (i) the energy storage member of the charger is operable to charge the capacitor of the portable surface cleaning unit at least twice using the stored power from the energy storage member of the charger in the absence of any power supply charging the energy storage member; and (ii) the surface cleaning apparatus is operable in an upright cleaning mode in which the suction motor is operable using power supplied from at least one of the capacitor and the energy storage member to draw in dirty air through the dirty air inlet, and the charger is concurrently operable to charge the capacitor using the stored power from the energy storage member.

2. The surface cleaning apparatus of claim 1 wherein the suction motor is not operable directly on power supplied by the energy storage member.

3. The surface cleaning apparatus of claim 1 wherein the suction motor is operable only from:

(a) power supplied from the capacitor, or (b) the surface cleaning apparatus further comprises an electrical cord connectable with a stationary source of power and the suction motor is operable from power supplied from the capacitor and power supplied from the stationary power supply.

4. The surface cleaning apparatus of claim 1 wherein the energy storage member is provided in the surface cleaning head.

5. The surface cleaning apparatus of claim 4 wherein the energy storage member has a center of gravity and the center of gravity is positioned forward of the center of the surface cleaning head.

6. The surface cleaning apparatus of claim 1 wherein the floor cleaning unit further comprises a thermal cooling unit thermally connected to the charger.

7. The surface cleaning apparatus of claim 6 wherein the charger is operable to recharge the capacitor at a rate of at least 4 C.

8. The surface cleaning apparatus of claim 6 wherein the charger is operable to recharge the capacitor at a rate of at least 6 C.

9. The surface cleaning apparatus of claim 1 wherein the capacitor comprises an ultra-capacitor.

10. The surface cleaning apparatus of claim 1 further comprising an electrical cord connectable with a stationary source of power.

11. The surface cleaning apparatus of claim 1 wherein the portable cleaning unit further comprises an electrical cord connectable with a stationary source of power.

12. The surface cleaning apparatus of claim 11 wherein the electrical cord is removably connectable with the portable cleaning unit.

13. The surface cleaning apparatus of claim 1 wherein the capacitor is removably mounted in the portable surface cleaning unit.

14. The surface cleaning apparatus of claim 1 wherein the portable surface cleaning unit comprises a hand vacuum cleaner and the upper section comprises a rigid air flow conduit having an upper end and a lower end, wherein the lower end of the rigid air flow conduit is moveably mounted to the surface cleaning head between the upright storage position and the rearwardly inclined floor cleaning position, and wherein the hand vacuum cleaner is connectable to the upper end of the rigid air flow conduit, whereby, when the hand vacuum cleaner is connected to the upper end of the rigid air flow conduit the handle is a steering handle for the floor cleaning unit.

15. The surface cleaning apparatus of claim 14 wherein the portable cleaning unit further comprises an electrical cord connectable with a stationary source of power.

16. The surface cleaning apparatus of claim 14 wherein the suction motor is operable only from:

(a) power supplied from the capacitor, or (b) the surface cleaning apparatus further comprises an electrical cord connectable with a stationary source of power and the suction motor is operable from power supplied from the capacitor and power supplied from the stationary power supply.

17. The surface cleaning apparatus of claim 14 wherein the energy storage member is provided in the surface cleaning head.

18. The surface cleaning apparatus of claim 17 wherein the energy storage member has a center of gravity and the center of gravity is positioned forward of the center of the surface cleaning head.

19. The surface cleaning apparatus of claim 1 wherein the charger is operable to recharge the capacitor at a rate of at least 4 C.

20. The surface cleaning apparatus of claim 1 wherein the energy storage member stores sufficient stored power to recharge the capacitor at least three times.

* * * * *